US007556021B2

(12) United States Patent
Toriumi et al.

(10) Patent No.: US 7,556,021 B2
(45) Date of Patent: Jul. 7, 2009

(54) FUEL DISTRIBUTION PIPE STRUCTURE IN MULTIPLE THROTTLE BODY

(75) Inventors: Masahiro Toriumi, Kawasaki (JP); Yoichi Yanagii, Kawasaki (JP)

(73) Assignee: Keihin Corporation, Tokyo (JP)

( * ) Notice: Subject to any disclaimer, the term of this patent is extended or adjusted under 35 U.S.C. 154(b) by 125 days.

(21) Appl. No.: 11/882,481

(22) Filed: Aug. 2, 2007

(65) Prior Publication Data

US 2008/0029062 A1 Feb. 7, 2008

(30) Foreign Application Priority Data

Aug. 3, 2006 (JP) ..... 2006-211819
Aug. 3, 2006 (JP) ..... 2006-211820

(51) Int. Cl.
*F02M 55/02* (2006.01)
*F02M 69/50* (2006.01)
*F02D 9/10* (2006.01)

(52) U.S. Cl. ..... 123/469; 123/456; 123/337

(58) Field of Classification Search ..... 123/468, 123/469, 456, 452, 184.25, 184.43, 184.48, 123/336, 337

See application file for complete search history.

(56) References Cited

U.S. PATENT DOCUMENTS 5,022,355 A * 6/1991 Billingsley et al. ..... 123/184.39
5,261,608 A * 11/1993 Hatzis et al. ..... 239/450
6,415,765 B1 * 7/2002 Akagi et al. ..... 123/336
6,732,711 B2 * 5/2004 Yanagii ..... 123/469
7,134,425 B2 * 11/2006 Taguchi et al. ..... 123/470
7,152,577 B2 * 12/2006 Nakagawa ..... 123/336
7,267,099 B2 * 9/2007 Takahashi et al. ..... 123/336

* cited by examiner

*Primary Examiner*—Stephen K Cronin
*Assistant Examiner*—Arnold Castro
(74) *Attorney, Agent, or Firm*—Bacon & Thomas, PLLC

(57) ABSTRACT

To improve maintenance workability of fuel injection valves in multiple throttle bodies, a distribution member (D) is provided with a fuel distribution path (3) communicating with a fuel inflow path (8), throttle body mounting holes (7, 7) and injection valve support member mounting holes (6, 6), injection valve support members (S, S) are provided with injection valve support bosses (12, 12), the distribution member (D) is screwed to the one and other side throttle bodies (T1, T2) via the throttle body mounting holes (7, 7), the other side end surfaces (11, 11) of the injection valve support members (S, S) are screwed on one and the other side end surfaces (1, 2) of the distribution member (D), and the other and one side fuel injection valves (Ja, Jb) are held by the injection valve support members (S, S) and the other and one side throttle body (T2, T1) respectively.

7 Claims, 13 Drawing Sheets

FUEL DISTRIBUTION PIPE STRUCTURE IN MULTIPLE THROTTLE BODY

BACKGROUND OF THE INVENTION

1. Field of the Invention

The present invention relates to a fuel distribution pipe supplying fuel boosted by a fuel source toward a fuel injection valve installed to a throttle body, and more particularly to a fuel distribution pipe structure in a multiple throttle body in which a plurality of throttle bodies are fixedly arranged adjacently side by side, and fuel is distributed and supplied to a fuel injection valve installed to each of the throttle bodies.

2. Description of the Conventional Art

As the conventional fuel distribution pipe in the multiple throttle body, there is a structure in Japanese Patent Application No. 2006-039086 filed by the applicant of the present application. In accordance with this structure, there is disclosed a technique of a fuel distribution pipe structure in a multiple throttle body in which a plurality of throttle bodies each provided with a fuel injection valve are fixedly arranged adjacently side by side, and fuel is supplied toward each of the fuel injection valves by a fuel distribution pipe, wherein the fuel distribution pipe is provided with a first injection valve insertion hole which is connected to a fuel distribution path provided in an inner portion and is open toward one side A, a second injection valve insertion hole which is connected to the fuel distribution path and is open toward the other side, a first mounting collar portion and a second mounting collar portion which are formed so as to protrude toward the one side A from one side wall, and a third mounting collar portion and a fourth mounting collar portion which are formed so as to protrude toward the other side B from the other side wall, a first support arm portion and a second support arm portion heading for the other side B are formed at the other side wall of the adjacent first throttle body so as to protrude, a third support arm portion and a fourth support arm portion heading for one side A are formed at one side wall of the adjacent second throttle body so as to protrude, the fuel distribution pipe is arranged between the other side wall of the adjacent first throttle body and one side wall of the second throttle body T2, a rear end portion of a first fuel injection valve installed to the first throttle body is inserted into the first injection valve insertion hole, a rear end portion of a second injection valve installed to the second throttle body is inserted into the second injection valve insertion hole, and the first mounting collar portion and the first support arm portion, the second mounting collar portion and the second support arm portion, the third mounting collar portion and the third support arm portion, and the fourth mounting collar portion and the fourth support arm portion are screwed and fixed respectively by a thread member.

SUMMARY OF THE INVENTION

Problem to be Solved by the Invention

In accordance with the conventional fuel distribution pipe structure in the multiple throttle body mentioned above, it is impossible to simply execute a replacing work of the fuel injection valve or a maintenance work thereof. This is because of the following reason. In this case, it is necessary to detach each of the fuel injection valves from the fuel distribution pipe by loosening the threads arranged between the first mounting collar portion and the first support arm portion, between the second mounting collar portion and the second support arm portion between the third mounting collar portion and the third support arm portion, and between the fourth mounting collar portion and the fourth support arm portion, for screwing the fuel distribution pipe and the respective throttle bodies detaching the fuel distribution pipe from each of the throttle bodies, and next moving each of the throttle bodies to a lower side. In accordance with the structure mentioned above, since attachment of the adjacent throttle bodies are canceled so as to come to a free state, it is necessary to reattach the adjacent throttle bodies after maintenance work of the fuel injection valve, so that there is a disadvantage that it is impossible to easily execute the maintenance work of the fuel injection valve. Further, in the conventional structure, in order to form the fuel distribution pipe by a synthetic resin material, a lot of developing man hour is necessary. This is because the first injection valve insertion hole, the second injection valve insertion hole, the first mounting collar portion, the second mounting collar portion, the third mounting collar portion and the fourth mounting collar portion are integrally formed in the fuel distribution pipe, so that the fuel distribution pipe is enlarged in size and the weight is increased, whereby it is necessary to give attention to a vibration proof particularly at a time of being mounted to a vehicle.

The present invention is made by taking the problem mentioned above into consideration, and an object of the present invention is to provided a fuel distribution pipe structure in a multiple throttle body in which a maintenance workability of a fuel injection valve can be improved, and a synthetic resin material can be easily employed.

Means for Solving the Problem

In accordance with a first aspect of the present invention, in order to achieve the object mentioned above, there is provided a fuel distribution pipe structure in a multiple throttle body in which throttle bodies each provided with a fuel injection valve are arranged adjacently so as to oppose to each other, and fuel is supplied toward each of the fuel injection valves from a fuel distribution pipe, wherein a distribution member in which one side end surface being a flat surface and the other side end surface being a flat surface are formed in parallel is provided with a fuel distribution path, throttle body mounting holes and injection valve support member mounting holes through from one side end surface toward the other side end surface, a fuel inflow path is provided so as to communicate toward the fuel distribution path, an injection valve support member in which one side end surface being a flat surface and the other side end surface being a flat surface are formed in parallel is continuously provided with an injection valve support boss extending along the other side end surface, and is provided with a fuel supply path connected to an injection valve support hole in which one end is open at the other side end surface and the other end is open at a lower end of the injection valve support boss, a mounting thread hole and a mounting hole are provided through from one side end surface toward the other side end surface, the distribution member is arranged between one side opposed side wall of the one side throttle body and the other side opposed side wall of the other side throttle body, these throttle bodies being adjacent, and is fixedly arranged by screwing to the one side throttle body and the other side throttle body via the throttle body mounting holes, the other side end surface of the injection valve support member is arranged on the one side end surface of the distribution member in a contact manner, thereby making the fuel distribution path of the distribution member communicate with the fuel supply path of the injection valve support member, the other side end surface of the injection valve support member is arranged on the other side end surface of the distribution member in a contact manner, thereby making the fuel distribution path of the distribution member communicate with the fuel supply path of the injection valve support member, the injection valve support member is fixedly arranged toward the distribution member by screwing via the injection valve support member mounting holes of the distribution member, a mounting female thread hole of the injection valve support member, and the mounting hole in the state mentioned above, the one side fuel injection valve arranged at the one side throttle body is held by the injection valve support hole provided in the one side throttle body and the injection valve support hole of the injection valve support member, and the other side fuel injection valve arranged at the other side throttle body is held by the injection valve support hole provided in the other side throttle body and the injection valve support hole of the injection valve support member.

Further, in accordance with a second aspect of the present invention, in addition to the feature of the invention in accordance with the first aspect mentioned above, the same injection valve support members are used for the injection valve support member arranged on the one side end surface of the distribution member and the injection valve support member arranged on the other side end surface of the distribution member.

In accordance with a third aspect of the present invention, there is provided a fuel distribution pipe structure in a multiple throttle body in which throttle bodies each provided with a fuel injection valve are arranged adjacently so as to oppose to each other, and fuel is supplied toward each of the fuel injection valves from a fuel distribution pipe, wherein a distribution member formed by a flat rigid material is provided with a communication hole, injection valve support member mounting holes and throttle body mounting holes through from one side end surface toward the other side end surface, a first injection valve support member having one side end surface arranged at one side of a first mounting collar portion and formed as a flat surface, and mounting holes provided through toward one side end surface is provided with a first injection valve support boss formed in parallel to the one side end surface, and a fuel inflow boss, a fuel inflow path communicates with a first fuel communication path provided so as to be open toward the one side end surface, from an end portion of the fuel inflow boss, a fuel supply path communicates therewith from a lower end of the first injection valve support boss via the injection valve support hole, a second injection valve support member having a one side end surface arranged at one side of the second mounting collar portion and formed as a flat surface, and mounting holes provided through toward the one side end surface is provided with a second injection valve support boss formed in parallel to the one side end surface, a fuel supply path communicates with a second fuel communication path provided so as to be open toward the one side end surface, from a lower end of the second injection valve support boss via an injection valve support hole, the distribution member is arranged between one side opposed side wall of the first throttle body and the other side opposed side wall of the second throttle body, both the throttle bodies being adjacent, and is fixedly arranged by screwing to the first throttle body and the second throttle body via the throttle body mounting holes, the first fuel communication path is held to communicate with the communication hole by arranging the one side end surface of the first injection valve support member on the other side end surface of the distribution member, a rear end of the first fuel injection valve having a leading end thereof installed to the first throttle body is inserted and held within the injection valve support hole, the second fuel communication path is held to communicate with the communication hole by arranging the one side end surface of the second injection valve support member on the one side end surface of the distribution member, a rear end of the second fuel injection valve having a leading end thereof installed to the second throttle body is inserted and held within the injection valve support hole, and the first injection valve support member, the distribution member and the second injection valve support member are fixed by screwing in a state mentioned above.

Further, in accordance with a fourth aspect of the present invention, in addition to the feature of the invention in accordance with the third aspect mentioned above, the first injection valve support member and the second injection valve support member are formed by a synthetic resin material, the first fuel communication path of the first injection valve support member and the second fuel communication path of the second injection valve support member are made to communicate by a tubular member arranged in an inner side of the communication hole of the distribution member, a first annular elastic member is arranged in a compression manner between an outer periphery of one end of the tubular member and an inner periphery of the first fuel passage, and a second annular elastic member is arranged in a compression manner between an outer periphery of the other end of the tubular member and an inner periphery of the second fuel communication path.

Further, in accordance with a fifth aspect of the present invention, in addition to the feature of the invention in accordance with the third aspect mentioned above, the first injection valve support member and the second injection valve support member are formed by a synthetic resin material, an insertion hole is provided toward the one side end surface of the first injection valve support member, the fuel inflow path communicates with an inner side of the insertion hole, the fuel supply path communicates with the fuel inflow path, an insertion protruding portion is formed at the one side end surface of the second injection valve support member so as to protrude, the fuel supply path is open toward a leading end portion of the insertion protruding portion, the insertion protruding portion is arranged in an inner side of the communication hole of the distribution member so as to be inserted into the insertion hole, and an annular elastic member is arranged in a compression manner between an outer periphery of the insertion protruding portion and an inner periphery of the insertion hole.

Further, in accordance with a sixth aspect of the present invention, in addition to the feature of the invention in accordance with the fourth or fifth aspect mentioned above, cylinder collars formed by a metal material are arranged so as to be inserted to the mounting holes of the first injection valve support body, the injection valve support member mounting holes of the distribution member, and the mounting holes of the second injection valve support body, an overall length H of the cylinder collar in a bolt fastening direction is set to $H \geqq N$ where N is the total thickness of a thickness of the first mounting collar portion of the first injection valve support body, a thickness of the distribution member, and a thickness of the second mounting collar portion of the second injection valve support body, and elastic pressing members having elastic force are provided in a compression manner among the first injection valve support member, the distribution member, and the second injection valve support member.

EFFECT OF THE INVENTION

In accordance with the invention on the basis of the first aspect of the present invention, the distribution member is held in the state of being fixed by screwing to the side walls of the adjacent one side and other side throttle bodies by the thread inserted into the throttle body mounting hole. In the state mentioned above, the screwing between each of the injection valve support members and the distribution member is canceled by loosening the thread inserted to the mounting thread hole of the injection valve support member, the mounting hole, and the injection valve support member mounting hole of the distribution member. Further, in the state mentioned above, it is possible to detach the other side fuel injection valve attached to the other side throttle body from the other side throttle body by moving the other side end surface of the one injection valve support member along the one side end surface of the distribution member. Further, it is possible to detach the one side fuel injection valve attached to the one side throttle body from the one side throttle body by moving the other side end surface of the other injection valve support member along the other side end surface of the distribution member. As mentioned above, since the maintenance of the fuel injection valve can be executed by canceling the screwing between each of the injection valve support member and the distribution member and moving the other side end surface of each of the injection valve support members along the end surface of the distribution member, it is possible to execute the maintenance work of the fuel injection valve easily and in a short time. Further, since the adjacent throttle bodies remain to be coupled by the distribution member and be in the fixed state, at such a working time, it is not necessary to reassemble the throttle body, the adjacent throttle bodies are maintained in the original assembled state, and it is not necessary to adjust and inspect a throttle link mechanism and the like arranged astride between the adjacent throttle bodies. Further, it is possible to execute the maintenance work of the fuel injection valve in a state that the throttle body is attached to an engine.

Further, in accordance with the invention on the basis of the second aspect of the present invention, in addition to the effect mentioned above, since the single injection valve support member is prepared, and the other side end surface of the injection valve support member is arranged on the one side end surface of the distribution member, it is possible to hold the other side fuel injection valve, and it is possible to hold the one side fuel injection valve by reversing the injection valve support member at 180 degree so as to arrange the other side end surface of the injection valve support member on the other side end surface of the distribution member. Accordingly, it is possible to use the same injection valve support members so as to reduce a manufacturing cost.

In accordance with the invention on the basis of the third aspect of the present invention, the distribution member is held in the state of being fixed by screwing to the side walls of the adjacent first and second throttle bodies by the thread inserted to the throttle body mounting hole. Further, the one side end surface of the first injection valve support member is arranged on the other side end surface of the distribution member, the one side end surface of the second injection valve support member is arranged on the one side end surface of the distribution member, and the first injection valve support member, the distribution member and the second injection valve support member are fixed by screwing in the state mentioned above. Further, the first fuel injection valve is held by the first throttle body and the first injection valve support member, and the second fuel injection valve is held by the second throttle body and the second injection valve support member. The screwing between the distribution member and the first and second injection valve support members is canceled at a time of the maintenance work of the first and second fuel injection valves, and it is possible to detach the first fuel injection valve in which the leading end thereof is installed to the first throttle body, by moving the one side end surface of the first injection valve support member along the other side end surface of the distribution member. Further, it is possible to detach the second fuel injection valve in which the leading end thereof is installed to the second throttle body, by moving the one side end surface of the second injection valve support member along the one side end surface of the distribution member. As mentioned above, since the maintenance work of the fuel injection valve can be executed by canceling the screwing between the first and second injection valve support members and the distribution member, and moving along the one side end surfaces of the first and second injection valve support members and the other side end surface and the one side end surface of the distribution member, it is possible to execute the maintenance work of the fuel injection valve extremely easily and in a short time. Further, at a time of the work mentioned above, since the adjacent throttle bodies remain to be coupled by the distribution member so as to be in the fixed state, it is not necessary to reassemble the throttle body, the adjacent throttle bodies are maintained in the original assembled state, and it is not necessary to adjust and inspect the throttle link mechanism and the like arranged astride between the adjacent throttle bodies. Further, it is possible to execute the maintenance work of the fuel injection valve in a state that the throttle body is attached to an engine. Further, since the distribution member is formed by the flat rigid material, it is preferable for arranging mutual longitudinal axes of the first fuel injection valve and the second fuel injection valve close to each other. This is particularly preferable for the multiple throttle body for a V-type engine. Further, the distribution member can be formed by press punching a metal sheet material, and it is possible to reduce a manufacturing cost.

Further, in accordance with the invention on the basis of the fourth aspect of the present invention, in addition to the effect of the invention in accordance with the third aspect mentioned above, since the first injection valve support member and the second injection valve support member are formed by the synthetic resin material, it is possible to achieve the reduction of the material cost and the weight saving. Further, since the fuel supplied from the fuel inflow path of the first injection valve support member is supplied to the second fuel communication path of the second injection valve support member via the first fuel communication passage and the tubular member, and particularly, since the first annular elastic member is arranged in the compression manner between the outer periphery of the one end of the tubular member and the inner periphery of the first fuel passage, and the second annular elastic member is arranged between the outer periphery of the other end of the tubular member and the inner periphery of the second fuel passage, it is possible to securely maintain airtightness of the fuel even if the injection valve support member is moved in the longitudinal direction of the tubular member due to an error at a time of injection molding of the injection valve support member or the like. Further, since it is possible to extremely easily control a hole diameter of each of the fuel communication paths by a plug gauge, and control of the hole diameter is easier in comparison with control of flatness of a flat surface, the structure is preferable from the viewpoint of manufacture.

Further, in accordance with the invention on the basis of the fifth aspect of the present invention, in addition to the effect of the invention in accordance with the third aspect mentioned above, since the fuel inflow path of the first injection valve support member can be made to communicate with the fuel supply path of the second injection valve support member by inserting the insertion protruding portion of the second injection valve support member into the insertion hole of the first fuel valve support member, it is not necessary to specially prepare any new communication member and it is possible to reduce a pats number and an assembling man hour. Further, airtightness in the insertion portion between the insertion hole and the insertion protruding portion is maintained by an annular elastic member provided in the compression manner between the outer periphery of the insertion tube portion and the inner periphery of the insertion hole.

Further, in accordance with the invention on the basis of the sixth aspect of the present invention, in addition to the effect of the invention in accordance with the fourth or fifth aspect mentioned above, since the overall length H of the cylinder collar is set to satisfy the relation of $H \geqq N$ where N is the total thickness of a thickness of the first mounting collar portion, a thickness of the distribution member and a thickness of the second mounting collar portion, it is possible to inhibit the fastening force of the bolt from being directly applied to the first and second mounting collar portions at a time of screwing the first mounting collar portion of the first injection valve support member and the second mounting collar portion of the second injection valve support member with the distribution member by the bolt, and it is preferable for forming the first and second injection valve support members by the synthetic resin material. Further, since the relation of $H \geqq N$ is set, a play may be formed in the longitudinal axial direction of the bolt in the first and second injection valve support members, particularly in the state of $H \geqq N$. However, since the elastic pressing member is arranged among the first injection valve support member, the distribution member and the second injection valve support member, it is possible to securely absorb the play mentioned above.

DETAILED DESCRIPTION OF PREFERRED EMBODIMENTS

Embodiment 1

Figure 1:
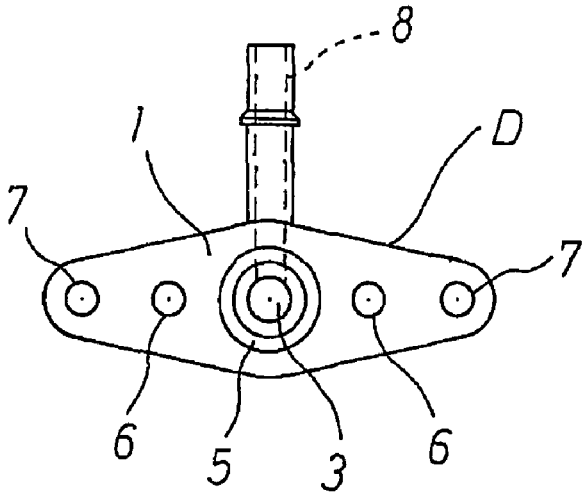
FIG. 1 is a front view showing a first embodiment of a distribution member used in a fuel distribution pipe structure in accordance with the present invention.
Figure 2:
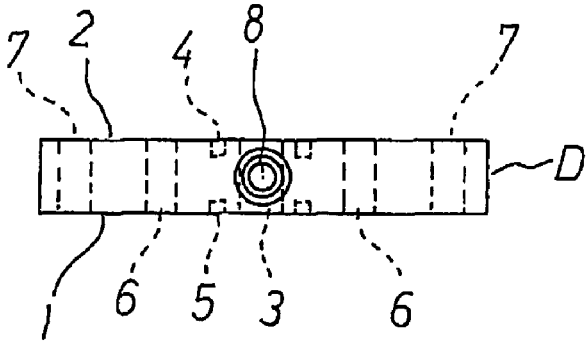
FIG. 2 is a plan view of an upper portion in FIG. 1.
Figure 3:
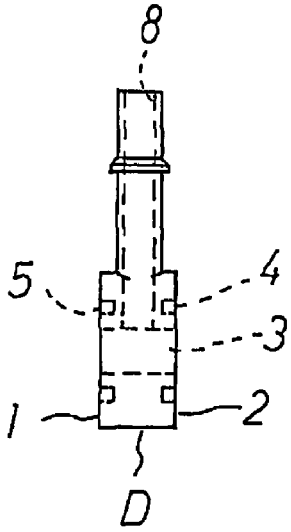
FIG. 3 is a side view of a right side in FIG. 1.

A description will be given below of a first embodiment in accordance with the present invention with reference to FIGS. 1 to 7. FIG. 1 is a front view of a distribution member used in a fuel distribution pipe structure in a multiple throttle body in accordance with the present invention. FIG. 2 is a plan view of an upper portion in FIG. 1. FIG. 3 is a side view of a right side in FIG. 1. A description will be given of a distribution member D with reference to FIGS. 1, 2 and 3. A distribution member D is formed in a thick flange shape, for example, having about 15 mm thickness in which one side end surface 1 forming a flat surface and the other side end surface 2 forming a flat surface are formed in parallel, and the following elements are provided from the one side end surface 1 toward the other side end surface 2. Reference numeral 3 denotes a fuel distribution path provided approximately in a center portion of the distribution member D. A first seal ring groove 4 is provided so as to surround the fuel distribution path 3 open at the other side end surface 2, and a second seal ring groove 5 is provided so as to surround the fuel distribution path 3 open at the one side end surface 1. Reference numeral 6 denotes an injection valve support member mounting hole provided at each of outer sides of the first and second seal ring grooves 4 and 5. The injection valve support member mounting hole 6 is formed so as to have a larger diameter than an outer diameter of a thread mentioned below. Reference numeral 7 denotes a throttle body mounting hole provided at a further outer side of each of the injection valve support member mounting holes 6 and 6. Further, a fuel inflow path 8 is open so as to communicate toward the fuel distribution path. The fuel inflow path 8 in the present embodiment is formed so as to protrude toward an upper side.

Figure 4:
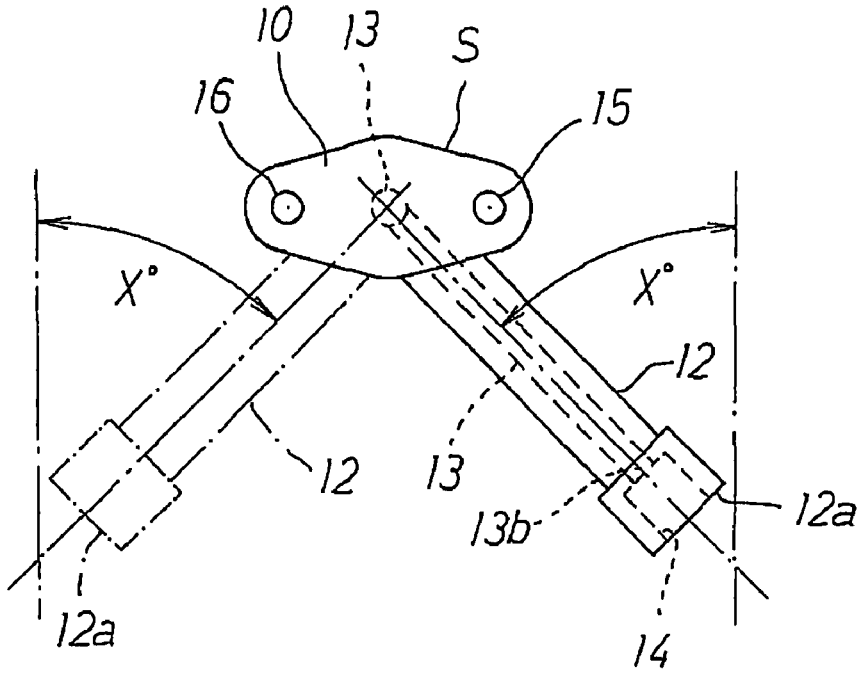
FIG. 4 is a front view showing a first embodiment of an injection valve support member used in the fuel distribution pipe structure in accordance with the present invention.
Figure 5:
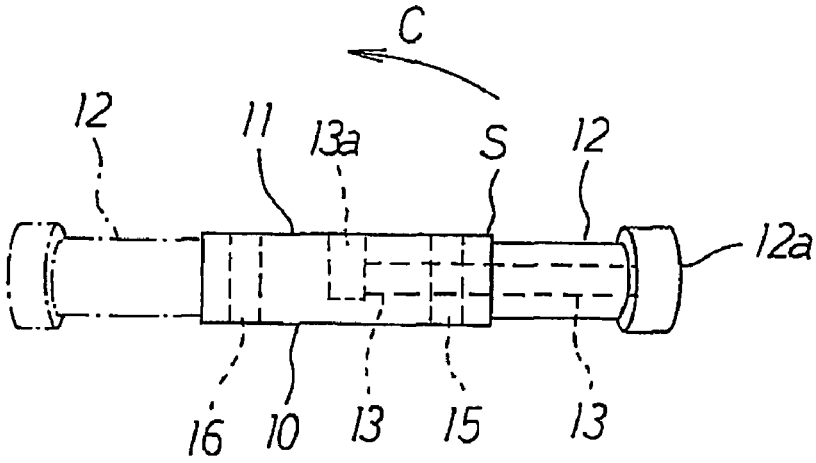
FIG. 5 is a plan view of an upper portion in FIG. 4.

Next, an injection valve support member S is formed as follows. FIG. 4 is a front view of the injection valve support member. FIG. 5 is a plan view of an upper portion in FIG. 4. The injection valve support member S is structured such that one side end surface 10 forming a flat surface and the other side end surface 11 forming a flat surface are formed in parallel, and an injection valve support boss 12 is continuously provided in a protruding manner at an outer periphery thereof so as to be along the other side end surface and toward a diagonally lower side. A fuel supply path 13 is provided within the injection valve support member S, one end 13*a* of the fuel supply path 13 is open at the other side end surface 11, the other end 13*b* is open at a lower end 12*a* of the injection valve support boss 12 toward a diagonally lower side, and is open to an injection valve support hole 14 to which a rear end portion of a fuel injection valve mentioned below is inserted. Further, a mounting thread hole 15 and a mounting hole 16 are provided through from the one side end surface 10 toward the other side end surface 11. In FIG. 5, the mounting thread hole 15 is provided at a right side from the one end 13*a* of the fuel supply path 13, and the mounting hole 16 is provided at a left side from the one end 13*a* of the fuel supply path 13.

Figure 6:
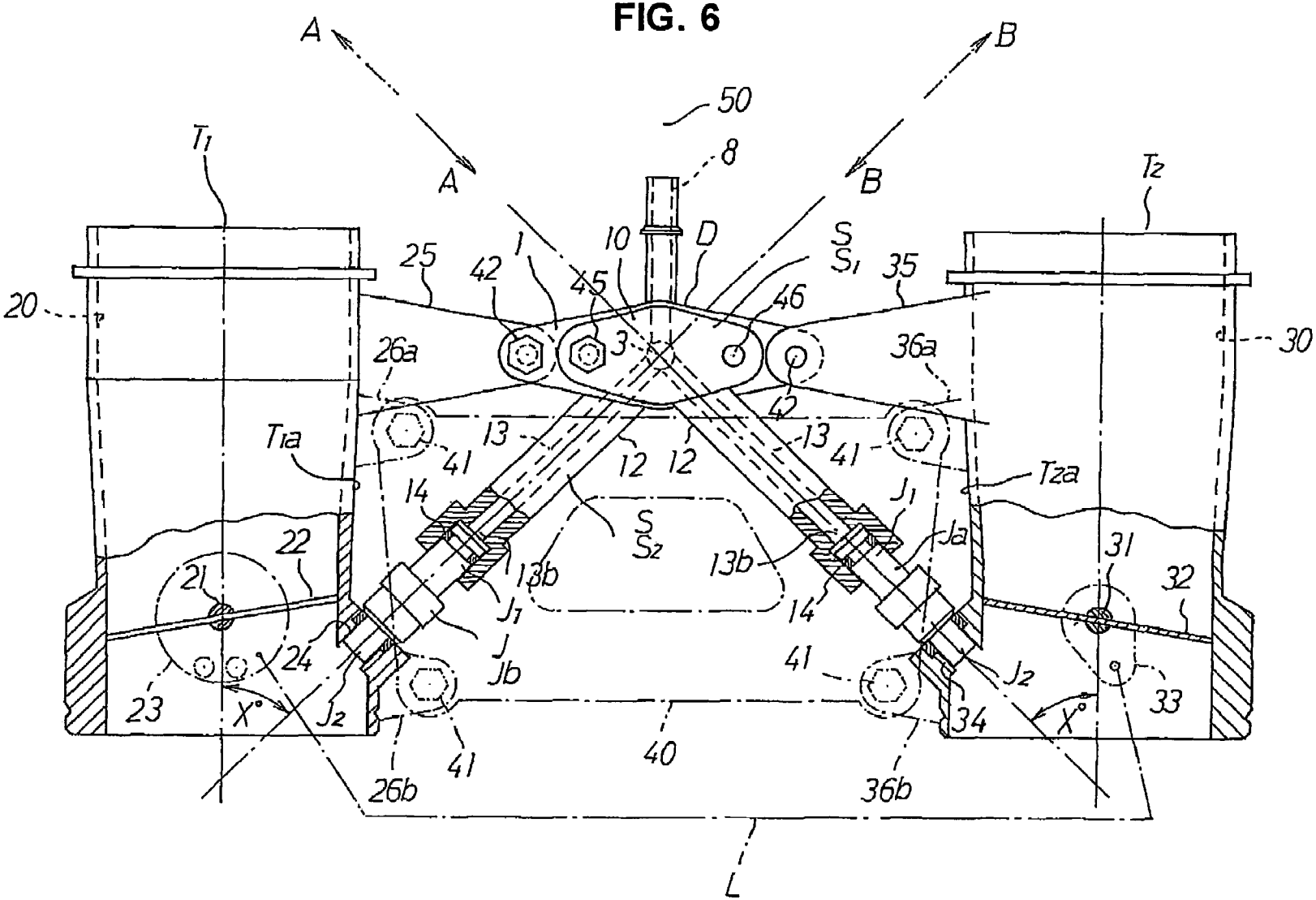
FIG. 6 is a front view showing a first embodiment of a fuel distribution pipe structure in a multiple throttle body in accordance with the present invention.
Figure 7:
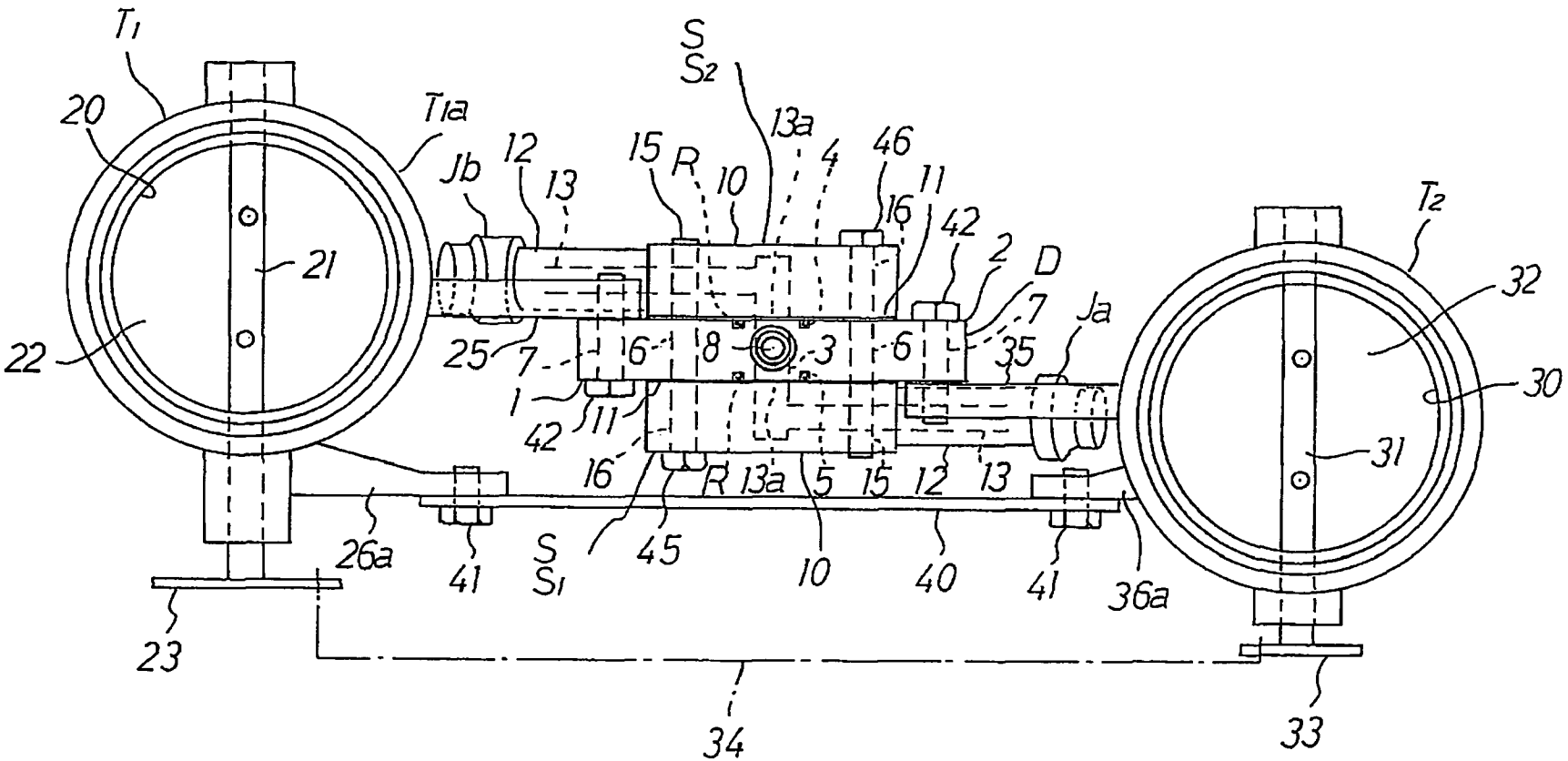
FIG. 7 is an upper plan view of a main portion in FIG. 6.

On the other hand, the multiple throttle body is structured such that single throttle body is arranged adjacently side by side. In FIG. 6, one side throttle body T1 is arranged at a left side thereof, and the other side throttle body T2 is arranged at a right side thereof. The one side throttle body T1 is provided with an intake passage 20 so as to pass through an inner portion thereof, and the intake passage 20 is opened and closed by a throttle valve 22 attached to a drive side throttle valve shaft 21. In this case, reference numeral 23 denotes a drive lever arranged at an end portion of the drive side throttle valve shaft 21. The drive lever 23 is coupled to an accelerator grip (not shown) via a valve opening wire and a valve closing wire. Further, an injection valve support hole 24 is provided in one side opposed side wall T1*a* of the one side throttle body T1 opposing to the other side throttle body T2, and the injection valve support hole 24 is provided at an angle of inclination X to a diagonally lower left side from the one side opposed side wall T1*a* toward an inner side of the intake passage 20 at a lower side of the throttle valve 22 and a leading end portion of a fuel injection valve mentioned below is arranged so as to be inserted thereto. Further, a distribution member mounting collar portion 25 is formed from the one side opposed side wall T1*a* of the one side throttle body T1 toward the other side throttle body T2 side. In this case, reference symbol 26*a* and 26*b* denote coupling collar portions formed so as to protrude from the one side opposed side wall T1*a* of the one side throttle body T1 toward the other side throttle body T2 side. The other side throttle body T2 is provided with an intake passage 30 so as to pass through an inner portion, and the intake passage 30 is opened and closed by a throttle valve 32 attached to a driven side throttle valve shaft 31. In this case, reference numeral 33 denotes a driven lever arranged at an end portion of a driven side throttle valve shaft 31. The driven lever 33 is synchronously coupled to the drive lever 23 by a throttle link mechanism L. Further, an injection valve support hole 34 is provided in the other side opposed side wall T2*a* of the other side throttle body T2 opposing to the one side throttle body T1, the injection valve support hole 34 is provided at the same angle of inclination X as mentioned above to a diagonally lower right side from the other side opposed side wall T2*a* toward an inner side of the intake passage 30 at the lower side of the throttle valve 32, and a leading end portion of the fuel injection valve mentioned below is arranged so as to be inserted thereto. Further, a distribution member mounting collar portion 35 is formed from the other side opposed side wall T2*a* of the other side throttle body T2 toward the one side throttle body T1 side. In this case, reference symbols 36*a* and 36*b* denote coupling collar portions formed so as to protrude from the other side opposed side wall T2*a* of the other side throttle body T2 toward the one side throttle body T1 side.

Further, the multiple throttle body is assembled as follows. The one side opposed side wall T1*a* of the one side throttle body T1 and the other side opposed side wall T2*a* of the other side throttle body T2 are arranged adjacently so as to be opposed, and a tabular coupling stay 40 and coupling collar portions 26*a*, 26*b*, 36*a* and 36*b* of the respective throttle bodies T1 and T2 are screwed fixedly by bolts 41, and the drive lever 23 and the driven lever 33 are synchronously coupled by a throttle link mechanism L. Further, the distribution member D is arranged within an adjacent space between the one side opposed side wall T1*a* of the one side throttle body T1 and the other side opposed side wall T2*a* of the other side throttle body T2, and is arranged so as to face to the distribution member mounting collar portion 25 of the one side throttle body T1 and the distribution member mounting collar portion 35 of the other side throttle body T2, and bolts 42 are inserted into the throttle body mounting holes 7 and 7, and are screwed to the distribution member mounting collar portions 25 and 35 in this state, whereby the distribution member D is screwed fixedly to the one side throttle body T1 and the other side throttle body T2 between the one side opposed side wall T1*a* of the one side throttle body T1 and the other side opposed side wall T2*a* of the other side throttle body T2. In this case, elastic seal rings R such as O-rings or the like are arranged within a first seal ring groove 4 and a second seal ring groove 5 open to the one side end surface 1 and the other side end surface 2 of the distribution member D.

Next, a rear end portion J1 of the other side fuel injection valve Ja is inserted in an airtight manner into the injection valve support hole 14 of the injection valve support member S in the state shown in FIG. 4 (the state that the injection valve support boss 12 protrudes toward a diagonally lower right side in FIG. 4), and the injection valve support member S provided with the other side fuel injection valve Ja mentioned above is arranged so as to be moved toward a diagonally lower right side (shown by reference symbol A in FIG. 6) in FIG. 6 in the state of facing the other side end surface 11 to the one side end surface 1 of the distribution member D. In accordance with the movement in the diagonally lower right direction A mentioned above, the leading end portion J2 of the other side fuel injection valve Ja is inserted in an airtight manner into the injection valve support hole 34 of the other side throttle body T2. On the other hand, the other side end surface 11 of the injection valve support member S moves in the diagonally lower right direction A on the one side end surface 1 of the distribution member D, the mounting thread hole 15 of the injection valve support member S is arranged so as to face to the right injection valve support member mounting hole 6 open at the one side end surface 1 of the distribution member D in the state that the leading end portion J2 of the other side fuel injection valve is completely inserted into the injection valve support hole 34 of the other side throttle body T2, the one end 13*a* of the fuel supply path 13 is arranged so as to face to the fuel distribution path 3 open at the one side end surface 1 of the distribution member D, and the mounting hole 16 is arranged so as to face to the left injection valve support member mounting hole 6 open at the one side end surface 1 of the distribution member D. In accordance with the structure mentioned above, the other side end surface 11 of the injection valve support member S is arranged on the one side end surface 1 of the distribution member D.

Next, another injection valve support member S as shown in FIG. 5 is prepared, and this injection valve support member S is held in the state of being rotated at 180 degree in the counterclockwise direction, which corresponds to a direction C in FIG. 5, from a state shown by a solid line in FIG. 5. This state is shown by a one-dot chain line in FIGS. 5 and 6. In FIG. 5, the one side end surface 10 exists at an upper position, and the other side end surface 11 exists at a lower position. The injection valve support boss 12 protrudes toward a diagonally lower left side in FIG. 4, and the other side end surface 11 at which the one end 13*a* of the fuel supply path 13 is open exists in the front side of the paper surface in FIG. 4. Further, in FIG. 4, the rear end portion J1 of the one side fuel injection valve Jb is inserted in an airtight manner into the injection valve support hole 14 open at the lower end 12*a* of the injection valve support boss 12 in the state of protruding to the diagonally lower left side, and the injection valve support member S provided with the one side fuel injection valve Jb is arranged so as to be moved toward a diagonally lower left side (shown by reference symbol B in FIG. 6) in FIG. 6 in the state of facing the other side end surface 11 to the other side end surface 2 of the distribution member D. In accordance with the movement in the diagonally lower left direction B, the leading end portion J2 of the one side fuel injection valve Jb is inserted in an airtight manner into the injection valve support hole 24 of the one side throttle body T1. On the other hand, the other side end surface 11 of the injection valve support member S is moved in the diagonally lower left direction B on the other side end surface 2 of the distribution member D, the mounting thread hole 15 of the injection valve support member S is arranged so as to face to the injection valve support member mounting hole 6 open at the other side end surface 2 of the distribution member D in the state that the leading end portion J2 of the one side fuel injection valve is completely inserted into the injection valve support hole 24 of the one side throttle body T1, the one end 13*a* of the fuel supply path 13 is arranged so as to face to the fuel distribution path 3 open at the other side end surface 2 of the distribution member D, and the mounting hole 16 is arranged so as to face to the injection valve support member mounting hole 6 open at the other side end surface 2 of the distribution member D. In accordance with the structure mentioned above, the other side end surface 11 of the injection valve support member S is arranged so as to face to the other side end surface 2 of the distribution member D.

Further, as mentioned above, in the state that the other side end surface 11 of the one injection valve support member S1 is arranged on the one side end surface 1 of the distribution member D, and the other side end surface 11 of the other injection valve support member S2 is arranged on the other side end surface 2 of the distribution member D, a bolt 45 is arranged so as to be screwed toward the injection valve support member mounting hole 6 of the distribution member D and the mounting thread hole 15 of the other injection valve support member S2 from the mounting hole 16 of the one injection valve support member S1. Further, a bolt 46 is arranged so as to be screwed toward the injection valve support member mounting hole 6 of the distribution member D and the thread hole 15 of the other injection valve support member S1 from the mounting hole 16 of the one injection valve support member S2. In this case, the one injection valve support member S1 is called as the lower injection valve support member, and the other injection valve support member S2 is called as the upper injection valve support member in the drawings, for making the description easy.

In accordance with the structure mentioned above, the other side end surface 11 of the one injection valve support member S1 is arranged on the one side end surface 1 of the distribution member D by screwing, the other side fuel injection valve Ja is held between the one injection valve support member S1 and the other side throttle body T2, the other side end surface 11 of the other injection valve support member S2 is arranged on the other side end surface 2 of the distribution member D by screwing, and the one side fuel injection valve Ja is held by the other injection valve support member S2 and the one side throttle body T1.

Further, the fuel inflow path 8 of the distribution member D and a discharge path of a fuel pump (not shown) are coupled by a fuel supply pipe 50, and fuel boosted to a fixed pressure by a fuel pump is supplied toward an inner side of the fuel distribution path 3 of the distribution member D via the fuel supply pipe 50 and the fuel inflow path 8. Further, a part of the fuel supplied into the fuel distribution path 3 is supplied to the other side fuel injection valve Ja from the one side end surface 1 of the distribution member D via the fuel supply path 13 of the one injection valve support member S1, and is injected and supplied into the intake passage 30 of the other side throttle body T2 from the other side fuel injection valve Ja. Further, the other part of the fuel supplied into the fuel distribution path 3 is supplied to the one side fuel injection valve Jb from the other side end surface 2 of the distribution member D via the fuel supply path 13 of the other injection valve support member S2, and is injected and supplied into the intake passage 20 of the one side throttle body T1 from the one side fuel injection valve Jb.

In this case, a replacement and an inspection of the fuel injection valve are executed as follows. First, the bolts 45 and 46 are loosened, and the screwing between the one injection valve support member S1 and the other injection valve support member S2, and the distribution member D is canceled. Further, in the state that the other side end surface 11 of the one injection valve support member S1 is approximately brought into contact with the one side end surface 1 of the distribution member D, the one fuel injection valve support member S1 is pulled up in the diagonally upper left direction as shown by the one-dot chain line A. In accordance with the structure mentioned above, it is possible to take out the leading end portion J2 of the other side fuel injection valve Ja from the injection valve support hole 34, and it is possible to take out the rear end portion J1 from the injection valve support hole 14 of the one injection valve support member S1 in the state mentioned above, whereby it is possible to execute the replacement and the inspection of the other side fuel injection valve Ja. Further, in the state that the other side end surface 11 of the other injection valve support member S2 is approximately brought into contact with the other side end surface 2 of the distribution member D, the other fuel injection valve support member S2 is pulled up in the diagonally upper right direction as shown by the one-dot chain line B. In accordance with the structure mentioned above, it is possible to take out the leading end portion J2 of the one side fuel injection valve Jb from the injection valve support hole 24, and it is possible to take out the rear end portion J1 from the injection valve support hole 14 of the other injection valve support member S2 in the state mentioned above, whereby it is possible to execute the replacement and the inspection of the one side fuel injection valve Jb. In accordance with the structure mentioned above, since it is possible to execute the replacement and the inspection of the one side and other side fuel injection valves Jb and Ja while keeping the one side throttle body T1 and the other side throttle body T2 in the state of being coupled and held by the coupling stay 40 and the distribution member D, it is possible to execute a maintenance work of the fuel injection valve extremely easily and in a short time. Further, since it is possible to execute the maintenance work of the fuel injection valve while keeping the one side and other side throttle bodies T1 and T2 in the coupled state, it is unnecessary to detach the throttle link mechanism and the like arranged astride between both the throttle bodies, and reassemble them.

Further, in a twin throttle body in which the one side throttle body T1 and the other side throttle body T2 are arranged adjacently, the fuel injection valve is generally arranged at each of the opposing one side opposed side wall T1*a* and the other side opposed side wall T2*a* of the throttle bodies T1 and T2, and the one side fuel injection valve Jb and the other side fuel injection valve Ja are arranged at the same angle of inclination X with respect to the longitudinal axis of the intake passage. In accordance with the structure mentioned above, it is possible to form the one injection valve support member S1 facing to the other side throttle body T2 and holding the other side fuel injection valve Ja only by preparing the injection valve support member S provided with the injection valve support boss 12 having the angle of inclination X with respect to a vertical line as shown in FIG. 4, and it is possible to form the other injection valve support member S2 facing to the one side throttle body T1 and holding the one side fuel injection valve Jb by rotating such the injection valve support member at 180 degree in a direction C as in FIG. 5. In accordance with the structure mentioned above, it is possible to use the same parts for both the one fuel valve support member S1 with the other injection valve support member S2, and it is possible to provide an inexpensive fuel distribution pipe structure.

Embodiment 2

Figure 9:
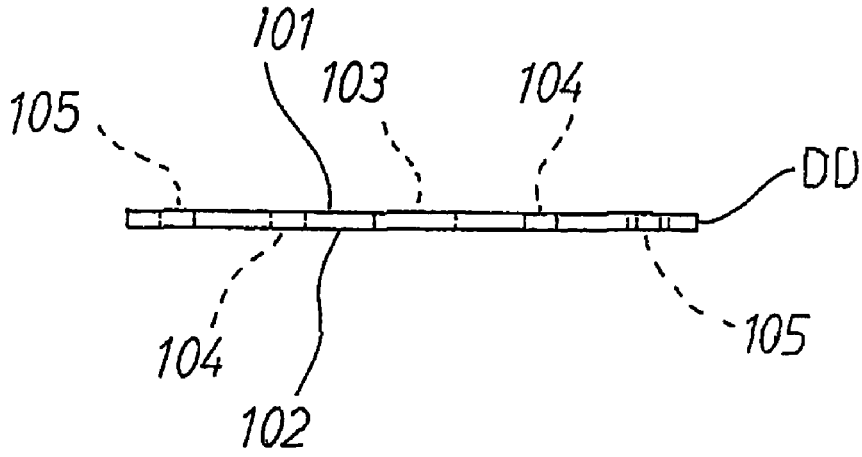
FIG. 9 is a plan view of an upper portion in FIG. 8.
Figure 8:
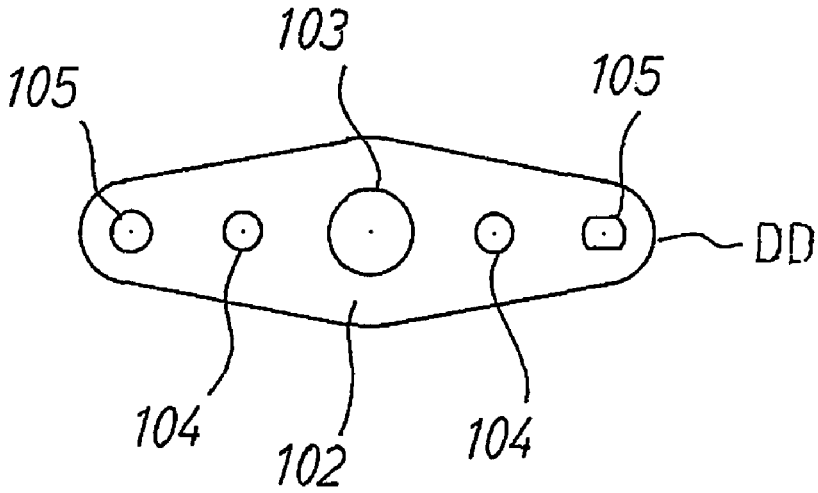
FIG. 8 is a front view showing a second embodiment of the distribution member used in the fuel distribution pipe structure in the multiple throttle body in accordance with the present invention.

Next, a description will be given of a second embodiment in accordance with the present invention with reference to FIGS. 8 to 17. FIG. 8 is a front view of a distribution member used in a fuel distribution pipe structure in a multiple throttle body in accordance with the present invention. FIG. 9 is a plan view of an upper portion in FIG. 8. A description will be given of a distribution member 100D with reference to FIGS. 8 and 9. The distribution member 100D is formed by a tabular rigid material (an iron plate, a stainless plate), for example, having a thickness of about 3 mm, in which one side end surface 101 being a flat surface and the other side end surface 102 being a flat surface are formed in parallel, and the following elements are provided from the one side end surface 101 toward the other side end surface 102. Reference numeral 103 denotes a communication hole provided approximately at a center portion of the distribution member 100D. Injection valve support member mounting holes 104 and 104 are provided at both sides of the communication hole 103, and throttle body mounting holes 105 and 105 are provided further at both sides thereof. The distribution member 100D is formed by a press punching.

Figure 11:
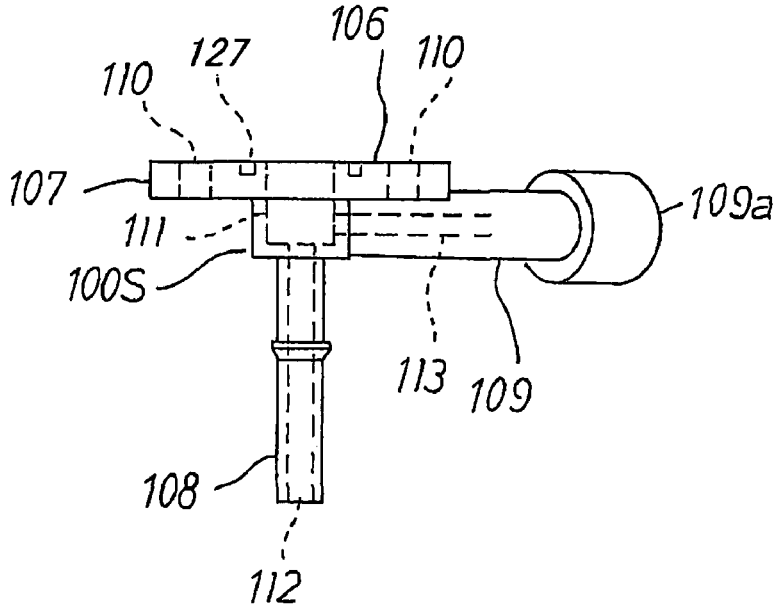
FIG. 11 is a plan view of an upper portion in FIG. 10.
Figure 10:
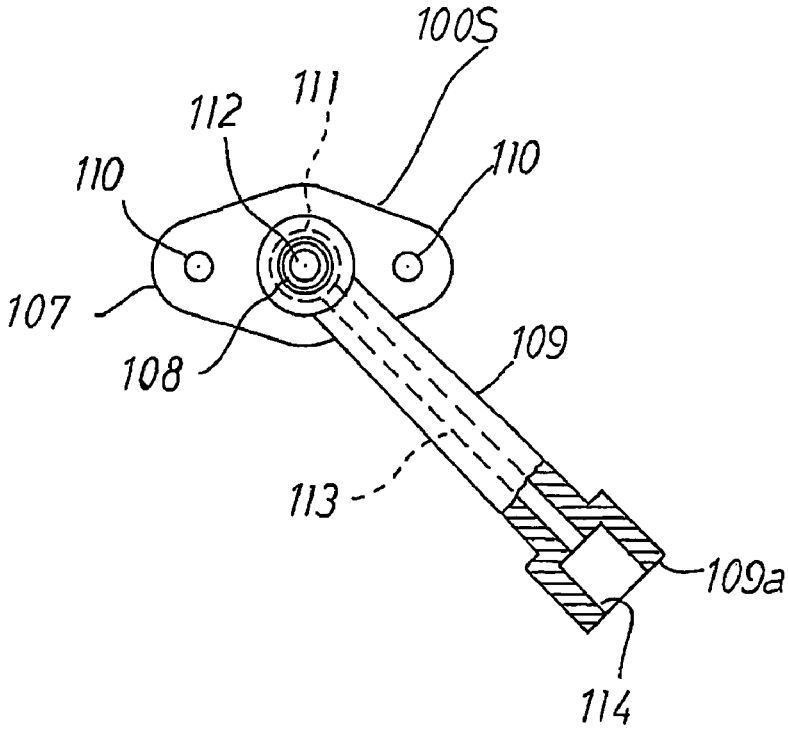
FIG. 10 is a front view showing a second embodiment of a first injection valve support member used in the fuel distribution pipe structure in the multiple throttle body in accordance with the present invention.

A first injection valve support member 100S is formed as follows. FIG. 10 is a front view of the first injection valve support member. FIG. 11 is a plan view of an upper portion in FIG. 10. The first injection valve support member 100S is formed by a first mounting collar portion 107 provided with one side end surface 106 forming a flat surface at one side, a fuel inflow boss 108 protruding to the other side from the first mounting collar portion 107, and a first injection valve support boss 109 protruding from the fuel inflow boss 108 including the first mounting collar portion 107 approximately in parallel along the one side end surface 106 and toward a diagonally lower right side in FIG. 3. Further, the first mounting collar portion 107 is provided with mounting holes 110 and 110 through toward the one side end surface and provided with a first fuel communication passage 111 in a concave shape so as to be open toward the one side end surface 106. Further, a fuel inflow path 112 is provided within the fuel inflow boss 108, and the fuel inflow path 112 communicates with the first fuel communication path 111. Further, a fuel supply path 113 is provided within the first injection valve support boss 109, an upper side of the fuel supply path 113 communicates with the first fuel communication path 111, and a lower side thereof communicates with an injection valve support hole 114 open at a lower end 109*a* of the first injection valve support boss 109. In this case, reference numeral 127 denotes a first seal ring groove provided in a concave shape at the one side end surface so as to surround an outer periphery of the first fuel communication path 111 open at the one side end surface 106.

Figure 13:
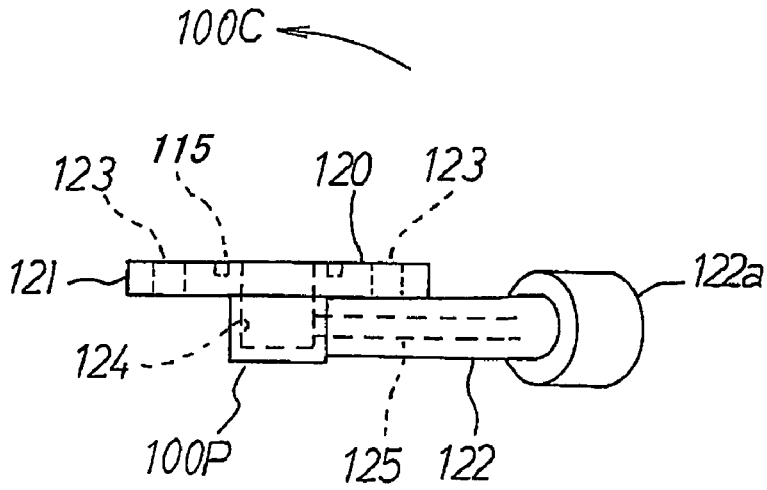
FIG. 13 is a plan view of an upper portion in FIG. 12.
Figure 12:
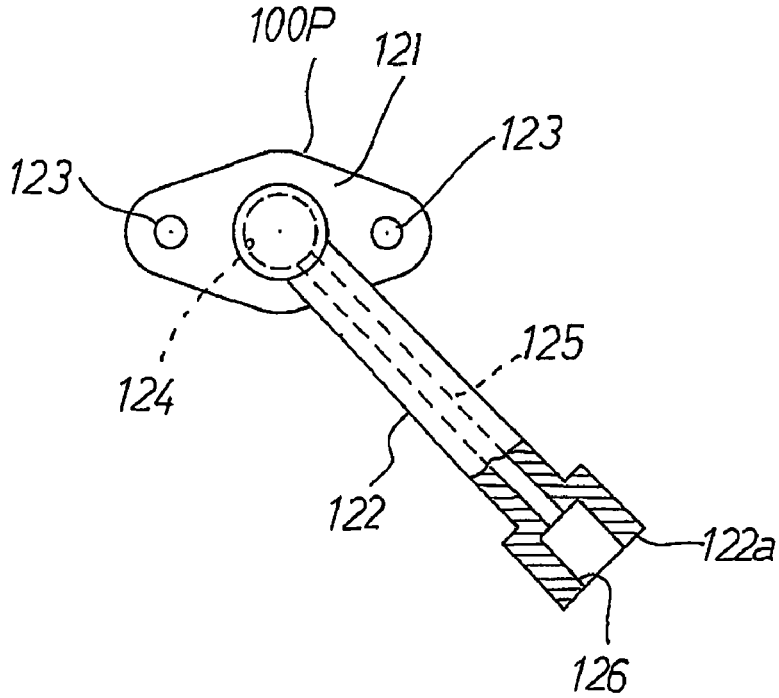
FIG. 12 is a front view showing a second embodiment of a second injection valve support member used in the fuel distribution pipe structure in the multiple throttle body in accordance with the present invention.

A second injection valve support member 100P is formed as follows. FIG. 12 is a front view of the second injection valve support member. FIG. 13 is a plan view of an upper portion in FIG. 12. The second injection valve support member 100P is formed by a second mounting collar portion 121 provided with one side end surface 120 forming a flat surface at one side, and a second injection valve support boss 122 protruding toward approximately in parallel along the second mounting collar portion 121 and the one side end surface 120 and toward a diagonally lower right side in FIG. 12. Further, the second mounting collar portion 121 is provided with mounting holes 123 and 123 through toward the one side end surface 120 and provided with a second fuel communication passage 124 in a concave shape so as to be open toward the one side end surface 120. Further, a fuel supply path 125 is provided within the second injection valve support boss 122, an upper side of the fuel supply path 125 communicates with the second fuel communication path 124, and a lower side thereof communicates with an injection valve support hole 126 open at a lower end 122*a* of the second injection valve support boss 122. In this case, reference numeral 115 denotes a second seal ring groove provided in a concave shape at the one side end surface 120 so as to surround an outer periphery of the second fuel communication path 124 open at the one side end surface 120.

Figure 14:
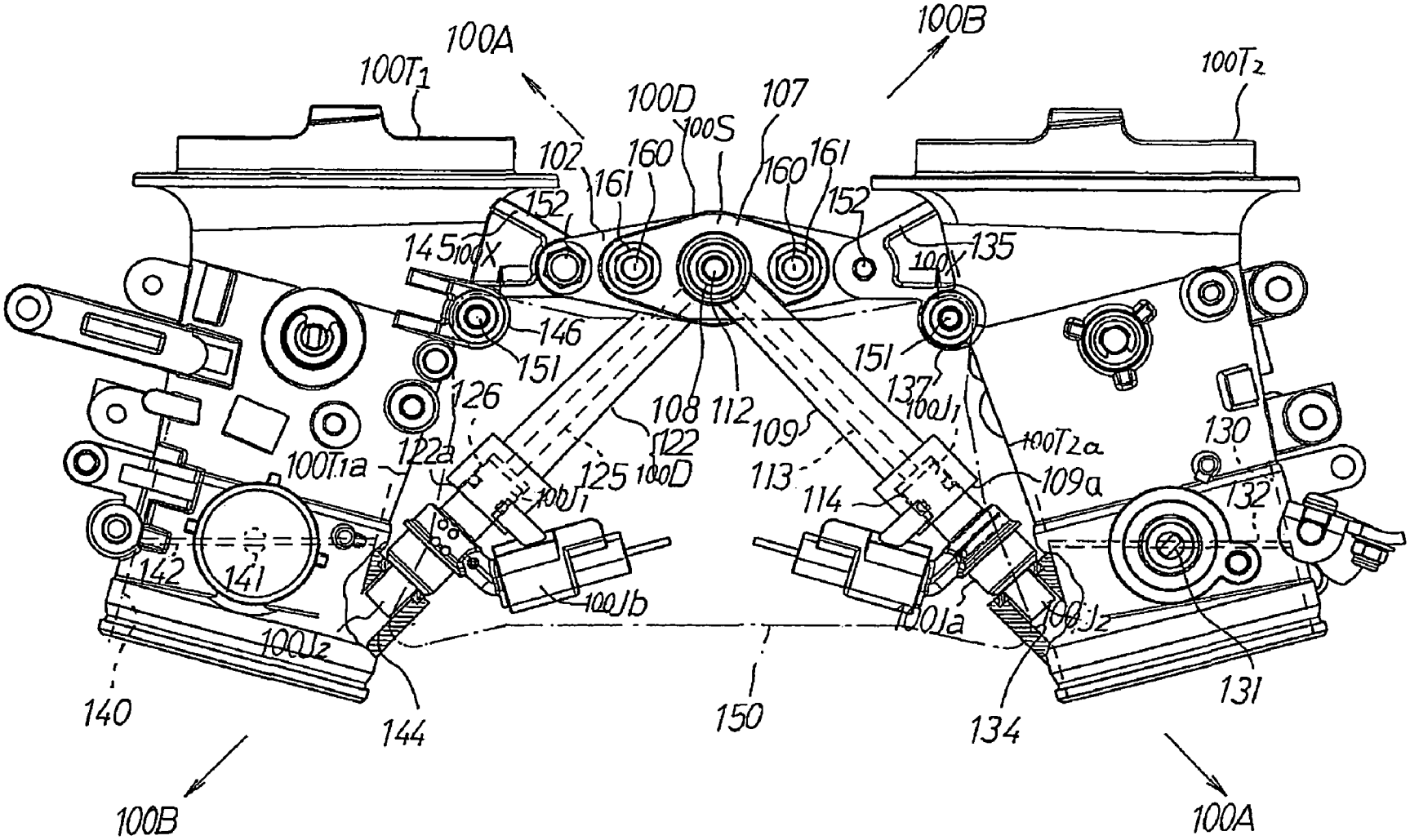
FIG. 14 is a front view showing a second embodiment of the fuel distribution pipe structure in the multiple throttle body in accordance with the present invention.
Figure 15:
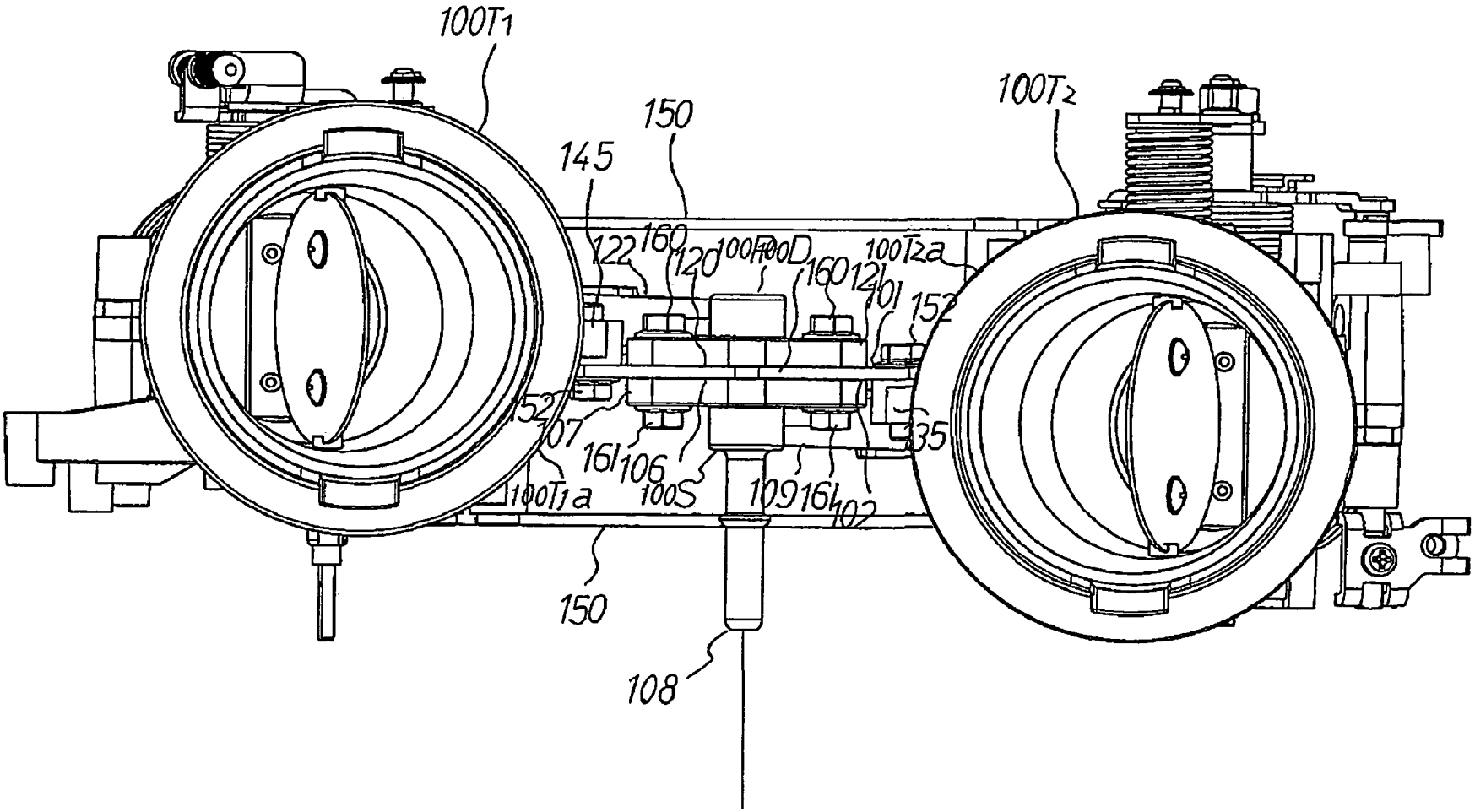
FIG. 15 is a plan view of an upper portion in FIG. 14.
Figure 16:
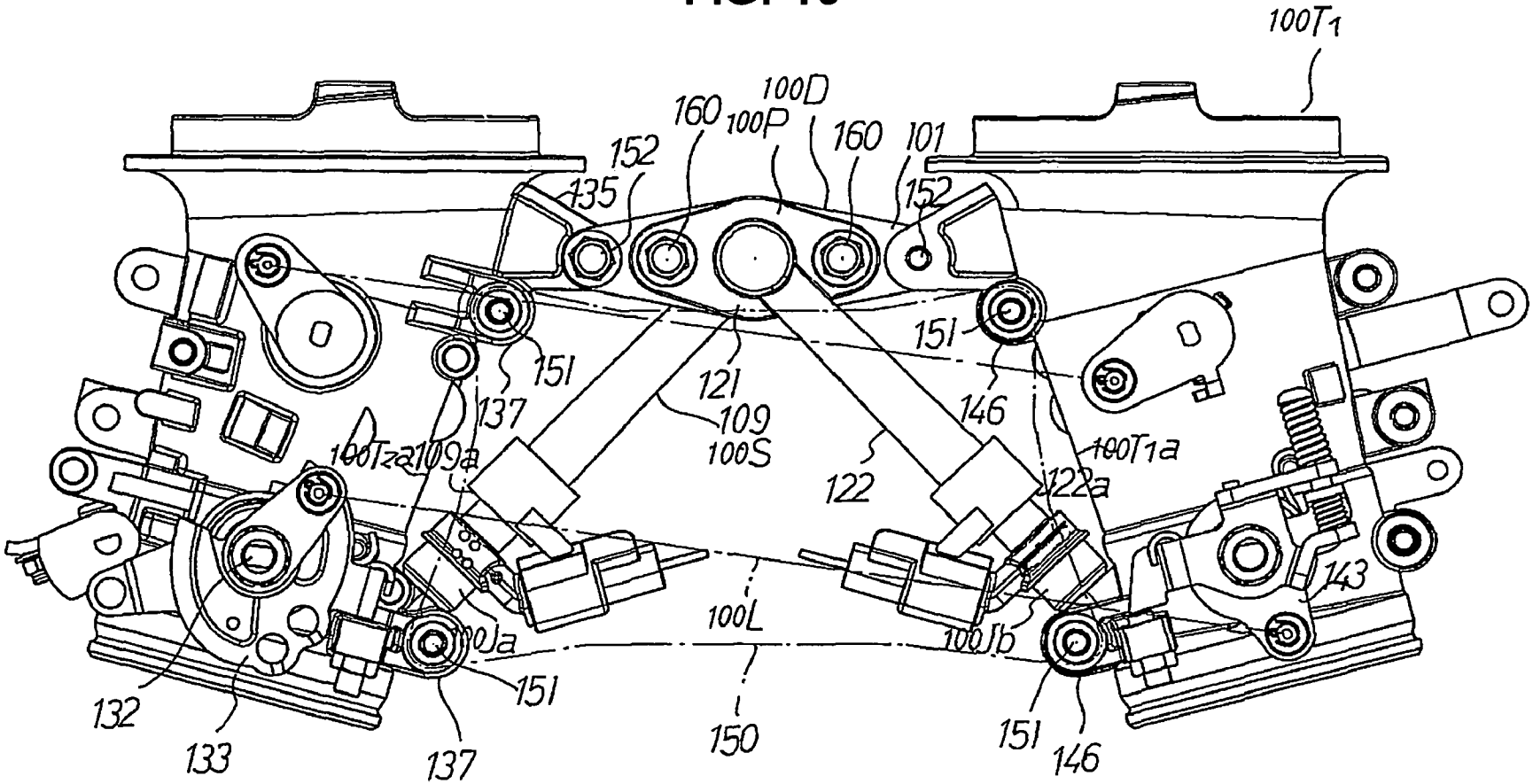
FIG. 16 is a rear view of FIG. 14.
Figure 17:
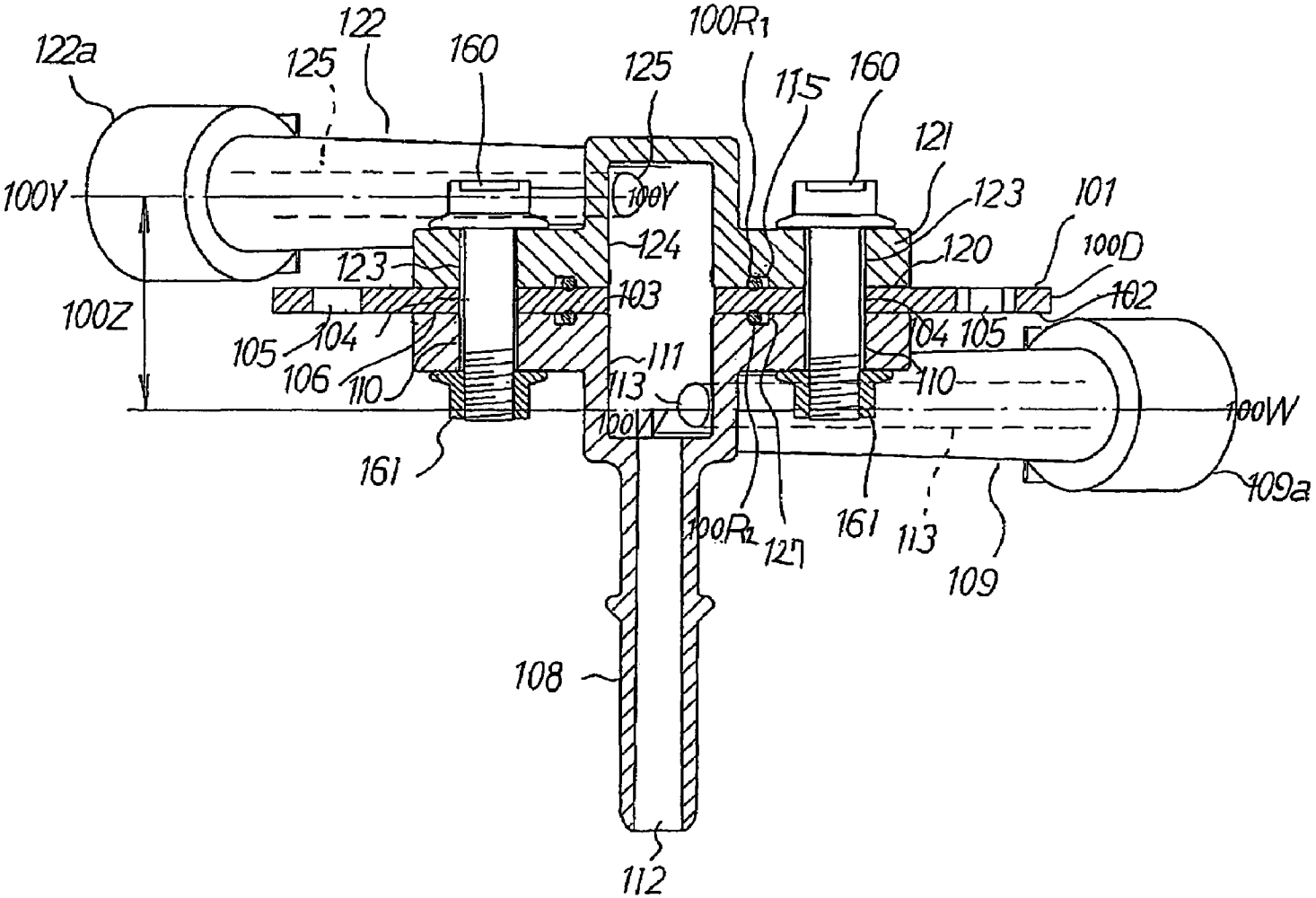
FIG. 17 is a vertical sectional view of a main portion at a line 100X-100X in FIG. 14.

On the other hand, the multiple throttle body is structured such that single throttle body is arranged adjacently side by side. In FIG. 14, the other side throttle body 100T2 is arranged at a right side thereof, and one side throttle body 100T1 is arranged at a left side thereof. The other side throttle body 100T2 is provided with an intake passage 130 so as to pass through an inner portion thereof, and the intake passage 130 is opened and closed by a throttle valve 132 attached to a drive side throttle valve shaft 131. In this case, reference numeral 133 denotes a drive lever arranged at an end portion of the drive side throttle valve shaft 131. The drive lever 133 is coupled to an accelerator grip (not shown) via a valve opening wire and a valve closing wire (the drive lever 133 is shown in FIG. 16). Further, an injection valve support hole 134 is provided at the other side opposed side wall 100T2*a* of the other side throttle body 100T2 opposing to the one side throttle body 100T1, and the injection valve support hole 134 is provided toward a diagonally lower right side from the other side opposed side wall 100T2*a* to the intake passage 130 at a lower side of the throttle valve 132 and a leading end of a fuel injection valve mentioned below is arranged so as to be inserted. Further, a distribution member mounting collar portion 135 is formed from the other side opposed side wall 100T2*a* of the other side throttle body 100T2 toward the one side throttle body 100T1 side. In this case, reference symbol 137 denotes a coupling collar portion formed so as to protrude from the other side opposed side wall 100T2*a* of the other side throttle body 100T2 toward the one side throttle body 100T1 side. The one side throttle body 100T1 is provided with an intake passage 140 so as to pass through an inner portion thereof, and the intake passage 140 is opened and closed by a throttle valve 142 attached to a driven side throttle valve shaft 141. In this case, reference numeral 143 denotes a driven lever arranged at an end portion of the driven side throttle valve shaft 141. The driven lever 143 is synchronously coupled to the drive lever 133 by a throttle link mechanism 100L (this is shown in FIG. 16). Further, an injection valve support hole 144 is provided at the one side opposed side wall 100T1*a* of the one side throttle body 100T1 opposing to the other side throttle body 100T2, the injection valve support hole 144 is provided toward a diagonally lower left side from the one side opposed side wall 100T1*a* to the intake passage 140 which is lower than the throttle valve 142, and a leading end portion of the fuel injection valve mentioned below is arranged so as to be inserted thereto. Further, a distribution member mounting collar portion 145 is formed from the one side opposed side wall 100T1*a* of the one side throttle body 100T1 toward the other side throttle body 100T2 side. In this case, reference symbol 146 denotes a coupling collar portion formed so as to protrude from the one side opposed side wall 100T1*a* of the one side throttle body 100T1 toward the other side throttle body 100T2 side.

Further, the multiple throttle body is assembled as follows. The other side opposed side wall 100T2*a* of the other side throttle body 100T2 and the one side opposed side wall 100T1*a* of the one side throttle body 100T1 are arranged adjacently so as to be opposed, and a tabular coupling stay 150 and coupling collar portions 137 and 146 of the respective throttle bodies 100T1 and 100T2 are screwed and fixed by bolts 151, and the drive lever 133 and the driven lever 143 are synchronously coupled by a throttle link mechanism 100L. Further, the distribution member D is arranged within an adjacent space between the other side opposed side wall 100T2*a* of the other side throttle body 100T2 and the one side opposed side wall 100T1*a* of the one side throttle body 100T1, and is arranged so as to face to a distribution member mounting collar portion 135 of the other side throttle body 100T2 and a distribution member mounting collar portion 145 of the one side throttle body 100T1, and bolts 152 are inserted into the throttle body mounting holes 105 and 105 and screwed to the distribution member mounting collar portions 135 and 145 in this state, whereby the distribution member 100D is screwed and fixed to the other side throttle body 100T2 and the one side throttle body 100T1 between the other side opposed side wall 100T2*a* of the other side throttle body 100T2 and the one side opposed side wall 100T1*a* of the one side throttle body 100T1.

Next, a rear end portion 100J1 of the other side fuel injection valve 100Ja is inserted in an airtight manner into the injection valve support hole 114 of the first injection valve support member 100S shown in FIG. 10, and the first injection valve support member 100S provided with the other side fuel injection valve 100Ja mentioned above is arranged so as to be moved toward a diagonally lower right side shown by reference symbol 100A in FIG. 14 in the state of facing the one side end surface 106 thereof to the other side end surface 102 of the distribution member 100D. In accordance with the movement in the diagonally lower right direction 100A mentioned above, the leading end portion 100J2 of the other side fuel injection valve 100Ja is inserted in an airtight manner into the injection valve support hole 134 of the other side throttle body 100T2. On the other hand, the one side end surface 106 of the first injection valve support member 100S moves in the diagonally lower direction 100A on the other side end surface 102 of the distribution member 100D, the mounting thread holes 110 and 110 of the first injection valve support member 100S are arranged so as to face to the injection valve support member mounting holes 104 and 104 of the distribution member 100D in the state that the leading end portion 100J2 of the first fuel injection valve is completely inserted into the injection valve support hole 134 of the other side throttle body 100T2, and the first fuel passage 111 is arranged so as to face to the communication hole 103 of the distribution member 100D. In accordance with the operation mentioned above, the arrangement of the first injection valve support member 100S on the other side end surface 102 of the distribution member 100D is finished.

Next, a rear end portion 100J1 of the one side fuel injection valve 100Jb is inserted in an airtight manner into the injection valve support hole 126 of the second injection valve support member 100P shown in FIG. 12, and the second injection valve support member 100P provided with the one side fuel injection valve 100Jb mentioned above is arranged so as to be moved toward a diagonally lower left side shown by reference symbol 100B in FIG. 14 in the state of facing the one side end surface 120 thereof to the one side end surface 101 of the distribution member 100D. In the operation mentioned above, the one side end surface 120 of the second injection valve support member 100P is brought into contact with the one side end surface 101 of the distribution member 100D by rotating at 180 degree in a direction 100C in FIG. 13. In accordance with the movement in the diagonally lower left direction 100B mentioned above, the leading end portion 100J2 of the one side fuel injection valve 100Jb is inserted in an airtight manner into the injection valve support hole 144 of the one side throttle body 100T1. On the other hand, the one side end surface 120 of the second injection valve support member 100P moves in the diagonally lower direction 100B on the one side end surface 101 of the distribution member 100D, the mounting holes 123 and 123 of the second injection valve support member 100P are arranged so as to face to the injection valve support member mounting holes 104 and 104 of the distribution member 100D in the state that the leading end portion 100J2 of the second fuel injection valve is completely inserted into the injection valve support hole 144 of the one side throttle body 100T1, and the second fuel communication path 124 is arranged so as to face to the communication hole 103 of the distribution member 100D. In accordance with the operation mentioned above, the arrangement of the second injection valve support member 100P on the one side end surface 101 of the distribution member 100D is finished.

Further, as mentioned above, in the state that the one side end surface 106 of the first injection valve support member 100S is arranged on the other side end surface 102 of the distribution member D, and the one side end surface 120 of the second injection valve support member 100P is arranged on the one side end surface 101 of the distribution member 100D, bolts 160 are inserted toward the mounting holes 123 and 123 of the second injection valve support member 100P, the injection valve support member mounting holes 104 and 104 of the distribution member 100D, and the mounting holes 110 and 110 of the first injection valve support member 100S, and nuts 161 are engaged with a protruding end of the bolts 160, whereby it is possible to screw and fix the first injection valve support member 100S and the second injection valve support member 100P to the distribution member 100D. Further, in accordance with the structure mentioned above, the other side fuel injection valve 100Ja is held by the injection valve support hole 134 of the other side throttle body 100T2 and the injection valve support hole 114 of the first injection valve support member 100S, and the one side fuel injection valve 100Jb is held by the injection valve support hole 144 of the one side throttle body 100T1 and the injection valve support hole 126 of the second injection valve support member 100P. On the other hand, the first fuel communication path 111 of the first injection valve support member 100S communicates with the second fuel communication path 124 of the second injection valve support member 100P via the communication hole 103 of the distribution member 100D. In this case, a second seal ring 100R2 is arranged within a second seal ring groove 127 of the first injection valve support member 100S, and a first seal ring 100R1 is arranged within a first seal ring groove 115 of the second injection valve support member 100P, whereby it is possible to keep an airtightness to ambient air between the first fuel communication path 111 and the second fuel communication path 124. In this case, the structure mentioned above is well shown in FIG. 17 corresponding to a horizontal sectional view of a main portion at a line 100X-100X in FIG. 14.

Further, fuel boosted by a fuel pump (not shown) is supplied to the fuel inflow path 112 of the first injection valve support member 100S, and a part of the fuel is supplied to the other side fuel injection valve 100Ja of the other side throttle body 100T2 via the first fuel communication passage 111 and the fuel supply path 113. On the other hand, the remaining fuel within the first fuel communication passage 111 is supplied to the one side fuel injection valve 100Jb of the one side throttle body 100T1 via the communication hole 103, the second fuel communication path 124 of the second injection valve support member 100P and the fuel supply path 125.

In this case, a replacement and an inspection of the fuel injection valve are executed as follows. First, the bolts 160 and the nuts 161 are loosened, and the screwing between the first injection valve support member 100S and the second injection valve support member 100P with respect to the distribution member 100D is canceled. Further, in the state that the one side end surface 106 of the first injection valve support member 100S is approximately brought into contact with the other side end surface 102 of the distribution member 100D, the first fuel injection valve support member 100S is pulled up in the diagonally upper left direction shown by the one-dot chain line 100A. In accordance with the operation mentioned above, it is possible to takeout the leading end portion 100J2 of the other side fuel injection valve 100Ja from the injection valve support hole 134 of the other side throttle body 100T2, and it is possible to take out the rear end portion 100J1 from the injection valve support hole 114 of the first injection valve support member 100S in the state mentioned above, whereby it is possible to execute the replacement and the inspection of the other side fuel injection valve 100Ja. Further, in the state that the one side end surface 120 of the second injection valve support member 100P is approximately brought into contact with the one side end surface 101 of the distribution member 100D, the second fuel injection valve support member 100P is pulled up in the diagonally upper right direction shown by the one-dot chain line 100B. In accordance with the operation mentioned above, it is possible to take out the leading end portion 100J2 of the one side fuel injection valve 100Jb from the injection valve support hole 144 of the one side throttle body 100T1, and it is possible to take out the rear end portion 100J1 from the injection valve support hole 126 of the second injection valve support member 100P in the state mentioned above, whereby it is possible to execute the replacement and the inspection of the one side fuel injection valve 100Jb. In this case, the one-dot chain lines 100A and 100B are shown in FIG. 14. In accordance with the structure mentioned above, since it is possible to execute the replacement and the inspection of the other side and one side fuel injection valves 100Jb and 100Ja while keeping the other side throttle body 100T2 and the one side throttle body 100T1 in the state of being coupled and held by the coupling stay 150 and the distribution member 100D, it is possible to execute a maintenance work of the fuel injection valves extremely easily and in a short time. Further, since it is possible to execute the maintenance work of the fuel injection valves while keeping the first and second throttle bodies 100T1 and 100T2 in the coupled state, it is unnecessary to detach and reassemble the throttle link mechanism and the like arranged astride between both the throttle bodies. Further, since the flat plate having the thickness of about 3 mm is used as the distribution member 100D, it is possible to arrange so as to make closer a distance 100Z between a longitudinal axis 100W-100W of the fuel supply path 113 provided in the first injection valve support boss 109 of the first injection valve support member 100S and a longitudinal axis 100Y-100Y of the fuel supply path 125 provided in the second injection valve support boss 122 of the second injection valve support member 100P, the members being arranged so as to be brought into contact with the other side end surface 102 and the one side end surface 101 of the distribution member 100D respectively, whereby such is preferably applied to a V twin type throttle body used in the V-type engine. The structure mentioned above is disclosed in FIG. 17. Further, since the distribution member 100D can be formed by press punching the thin metal material, it is effective for reducing the manufacturing cost. In this case, the fuel inflow boss 108 including the fuel inflow path 112 may be provided in the second injection valve support member 100P.

Embodiment 3

Figure 18:
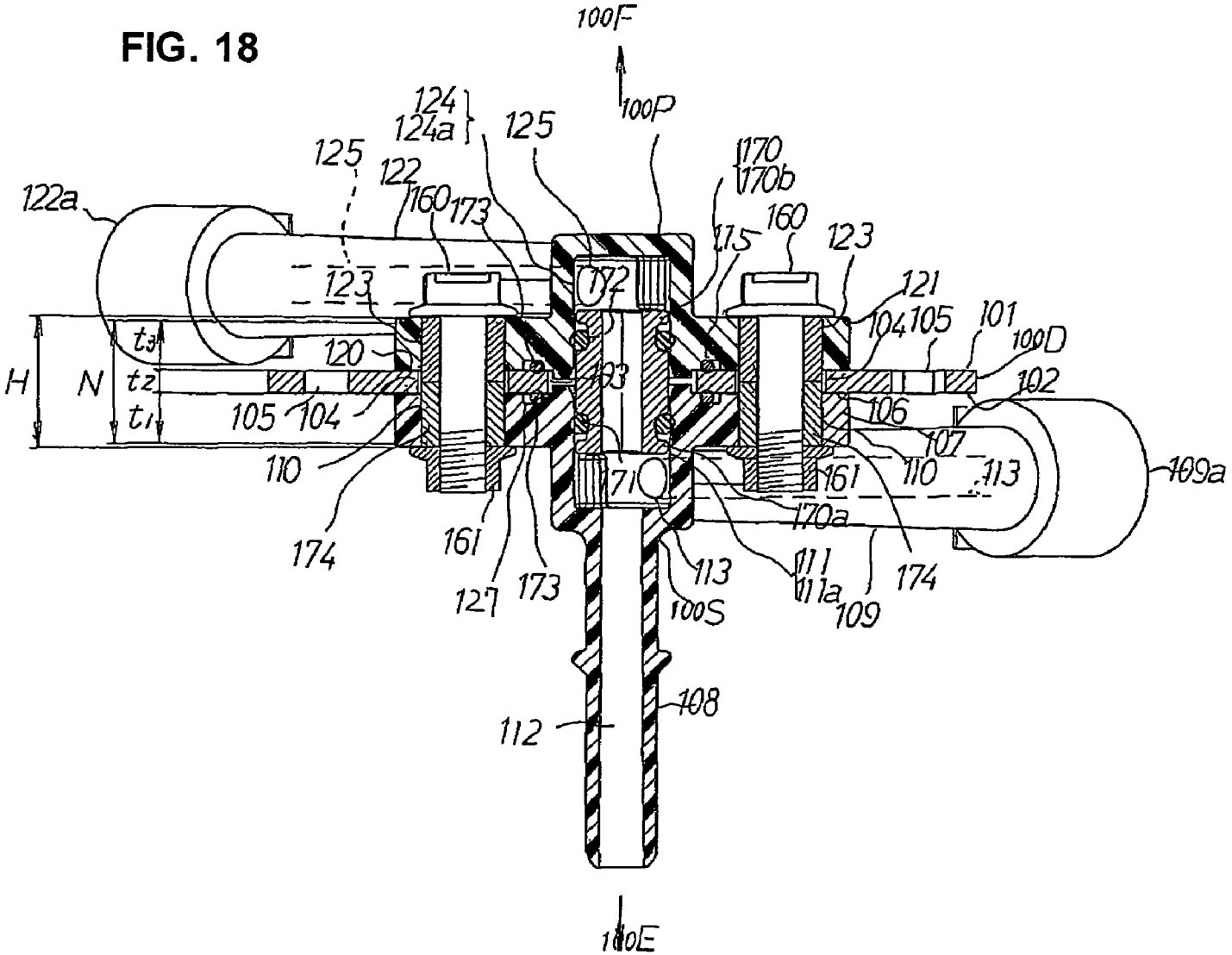
FIG. 18 is a vertical sectional view of a main portion at a position corresponding to FIG. 17 showing a third embodiment of the fuel distribution pipe structure in the multiple throttle body in accordance with the present invention.

Next, a description will be given of a main portion of a third embodiment in accordance with the present invention with reference to FIG. 18. In this case, the same reference numerals are attached to the same structural portions as those of the embodiments mentioned above, and a description thereof will be omitted. The one side end surface 106 of the first injection valve support member 100S is arranged on the other side end surface 102 of the distribution member 100D, and at this time, the first fuel communication passage 111 is arranged so as to face to an inner side of the communication hole 103 of the distribution member 100D, and the mounting holes 110 and 110 are arranged so as to face to the injection valve support member mounting holes 104 and 104 of the distribution member 100D. The rear end portion 100J1 of the other side fuel injection valve 100Ja (not shown) is arranged so as to be inserted into the injection valve support hole 114. On the other hand, the one side end surface 120 of the second injection valve support member 100P is arranged on the one side end surface 101 of the distribution member 100D, and at this time, the second fuel passage 124 is arranged so as to face to the inner side of the communication hole 103 of the distribution member 100D, the mounting holes 123 and 123 are arranged so as to face to the injection valve support member mounting holes 104 and 104 of the distribution member 100D, and the rear end portion 100J1 of the one side fuel injection valve 100Jb (not shown) is arranged so as to be inserted into the injection valve support hole 126. Further, in the state mentioned above, a tubular member 170 provided with a through hole in an inner side is arranged so as to be inserted to the first fuel communication passage 111 of the first injection valve support member 100S and the second fuel communication passage 124 of the second injection valve support member 100P. Further, a first annular elastic member 171 such as an O-ring or the like is provided in a compression manner between an outer periphery 170*a* of one end of the tubular member 170 and an inner periphery 111*a* of the first fuel communication path 111, and a second annular member 172 such as an O-ring or the like is provided in a compression manner between an outer periphery 170*b* of the other end of the tubular member 170 and an inner periphery 124*a* of the second fuel communication path 124. Further, an elastic pressing member 173 such as an O-ring or the like is arranged within the second seal ring groove 127 provided at a concave manner in the one side end surface 106 of the first injection valve support member 100S, and the elastic pressing member 173 is arranged in a compression manner between the one side end surface 106 of the first injection valve support member 100S and the other side end surface 102 of the distribution member 100D. Further, an elastic pressing member 173 is arranged within the first seal ring groove 115 provided in a concave manner at the one side end surface 120 of the second injection valve support member 100P, and the elastic pressing member 173 is arranged in a compression manner between the one side end surface 120 of the second injection valve support member 100P and the one side end surface 101 of the distribution member 100D. Further, reference numeral 174 denotes cylinder collars arranged so as to be inserted into the mounting holes 110 and 110 of the first injection valve support member 100S, the injection valve support member mounting holes 104 and 104 of the distribution member 100D and the mounting holes 123 and 123 of the second injection valve support member 100P. The cylinder collars 174 are formed as mentioned below. The cylinder collars 174 are formed by a metal material such as a stainless steel, an aluminum or the like, and a length H in a longitudinal direction is set to the relation of H≧N, where N is the total thickness of a thickness t1 of the first mounting collar portion 107 of the first injection valve support member 100S, a thickness t2 of the distribution member 100D and a thickness t3 of the second mounting collar portion 121 of the second injection valve support member 100P. In this case, each of the length and the thicknesses has a tolerance in manufacturing thereof, however, the relation H≧N can be maintained even in the case of taking the tolerance into consideration.

Further, the first injection valve support member 100S and the second injection valve support member 100P are formed by injection molding a synthetic resin material such as PA66 or the like.

In accordance with the embodiment mentioned above, in the first injection valve support member 100S arranged on the other side end surface 102 of the distribution member 100D and the second injection valve support member 100P arranged on the one side end surface 101 of the distribution member 100D, the cylinder collars 174 and 174 are arranged within the mounting holes 110 and 110, the injection valve support member mounting holes 105 and 105 and the mounting holes 123 and 123, and are screwed and fixed by bolts 160 inserted into the cylinder collars 174 and 174, and nuts 161 engaged with the protruding ends of the bolts 160. A part of fuel flowing into the first fuel communication path 111 from the fuel inflow path 112 is supplied to the other side fuel injection valve 100Ja from the fuel supply path 113, and the other portion of the fuel within the first fuel communication path 111 is supplied to the one side fuel injection valve 100Jb via the tubular member 170, the second fuel communication path 124, and the fuel supply path 125. Further, at this time, the fuel within the first fuel communication path 111 is held airtight by the first annular elastic member 171 provided in the compression manner between the outer periphery 170*a* of one end of the tubular member 170 and the inner periphery 111*a* of the first fuel communication path 111, and the fuel within the second fuel communication path 124 is held airtight by the second annular elastic member 172 provided in the compression manner between the outer periphery 170*b* of the other end of the tubular member 170 and the inner periphery 124*a* of the second fuel communication path 124. As mentioned above, in the case of manufacturing the first and second injection valve support members 100S and 100P by using a synthetic resin, a dimensional dispersion tends to be generated at a time of molding in the longitudinal direction of the tubular member 170 (for example, a dispersion is generated in a flatness of the one side end surfaces 106 and 120). However, since the first fuel communication path 111 and the second fuel communication path 124 communicates in the longitudinal direction by the tubular member 170, it is possible to well maintain the airtightness even at the time mentioned above. Further, since it is possible to extremely easily execute control of the hole diameter of the first fuel communication path 111 of the first injection valve support member 100S and the second fuel communication path 124 of the second injection valve support member 100P by a plug gauge in comparison with a control of the flatness of the one side end surfaces 106 and 120, this structure is effective particularly in the case of in the injection valve support member using a synthetic resin material which generates a dimensional dispersion caused by a shrinkage at a time of molding.

Further, since the thickness H of the cylinder collar 174 is set to the relation H≧N, the fastening force generated by the bolts 160 is not directly applied to the first mounting collar portion 107 and the second mounting collar portion 121, at a time of screwing the first and second injection valve support members 100S and 100P to the distribution member 100D via the cylinder collars 174 by the bolts 160 and the nuts 161, and it is possible to well screw the first and second injection valve support members 100S and 100P toward the distribution member 100D. This is effective at a time of forming the first and second injection valve support members 100S and 100P by using a synthetic resin material.

Further, since the thickness H of the cylinder collar 174 mentioned above is set to the relation of H≧N, gaps are formed between the other side end surface 102 of the distribution member 100D and the one side end surface 106 of the first injection valve support member 100S, and between the one side end surface 101 of the distribution member 100D and the one side end surface 120 of the second injection valve support member 100P, and there is the case that rattling is generated between the first and second injection valve support members 100S and 100P and the distribution member 100D when the fuel is not supplied from the fuel inflow path 112, for example, at a time of assembling and carrying. However, the rattling can be dissolved by arranging in the compression manner the elastic pressing members 173 between the one side end surface 106 of the first injection valve support member 100S and the other side end surface 102 of the distribution member 100D, and between the one side end surface 120 of the second injection valve support member 100P and the one side end surface 101 of the distribution member 100D, and such is preferable at a time of forming the first and second injection valve support members 100S and 100P by a synthetic resin material.

In this case, in the present embodiment, at a time of detaching the first injection valve support member 100S and the second injection valve support member 100P from the distribution member 100D, it is necessary to take out a lower half of the tubular member 170 from the first fuel communication path 111 and take out an upper half of the tubular member 170 from the second fuel communication path 124. Since the first and second fuel communication paths 111 and 124 and the injection valve support holes 114 and 126 are positioned so as to be apart at a distance, and the rear end portion 100J1 of the fuel injection valves are inserted to the injection valve support holes 114 and 126 via the elastic members such as O-rings or the like, it is possible to move the one side end surface 106 of the first injection valve support member 100S in a direction 100E for detaching from the other side end surface 102 of the distribution member 100D, and it is possible to move the one side end surface 120 of the second injection valve support member 100P in a direction 100F for detaching from the one side end surface 101 of the distribution member 100D, whereby it is possible to easily separate and move the distribution member 100D and the first and second injection valve support members 100S and 100P. The detaching directions 100E and 100F mentioned above are shown in FIG. 18. In this case, the maintenance work of the fuel injection valves 100Ja and 100Jb can be executed in the same manner as the first embodiment mentioned above.

Embodiment 4

Figure 19:
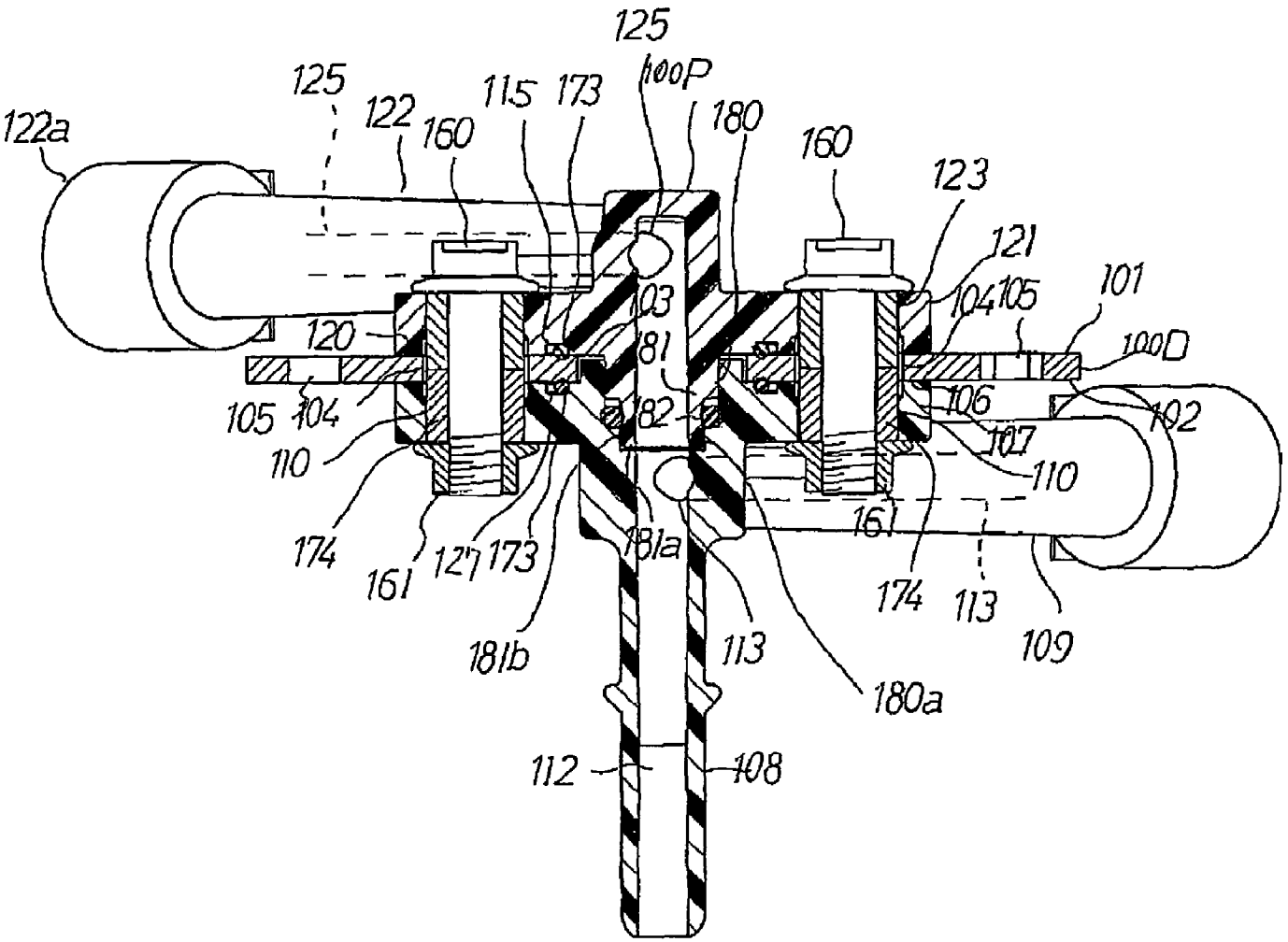
FIG. 19 is a vertical sectional view of a main portion at a position corresponding to FIG. 17 showing a fourth embodiment of the fuel distribution pipe structure in the multiple throttle body in accordance with the present invention.

A fourth embodiment is shown in FIG. 19. In this case, the same reference numerals are attached to the same structure portions as those in FIG. 18, and a description thereof will be omitted. An insertion hole 180 is provided in a concave manner so as to be open toward the one side end surface 106 of the first injection valve support member 100S, the fuel inflow path 112 communicates toward a bottom portion of the insertion hole 180, and the fuel supply path 113 heading for the injection valve support hole is branched from the fuel inflow path 112. Further, there is formed an insertion protruding portion 181 inserted into the insertion hole from the one side end surface 120 of the second injection valve support member 100P, and the fuel supply path 125 provided within the second injection valve support member 100P is open at a leading end portion 181*a* of the insertion protruding portion 181. The one side end surface 106 of the first injection valve support body 100S mentioned above is arranged on the other side end surface 102 of the distribution member 100D, and the insertion hole 180 is arranged in an inner side of the communication hole 103 of the distribution member 100D. On the other hand, the one side end surface 120 of the second injection valve support body 100P is arranged on the one side end surface 101 of the distribution member 100D, and the insertion protruding portion 181 is arranged so as to be inserted into the insertion hole 180 in the inner side of the communication hole 103 of the distribution member 100D. Further, an annular elastic member 182 is arranged in a compression manner between an outer periphery 181*b* of the insertion protruding portion 181 and an inner periphery 180*a* of the insertion hole 180. Further, the first and second injection valve support members 100S and 100P in the state mentioned above are screwed and fixed to the distribution member 100D by bolts 160 and nuts 161 in the same manner as the embodiment shown in FIG. 18. In accordance with the structure mentioned above, fuel within the fuel inflow path 112 is supplied to the fuel supply path 113 of the first injection valve support member 100S, the fuel within the fuel inflow path 112 is supplied to the fuel supply path 125 of the second injection valve support member 100P, and the airtightness between the insertion hole 180 and the insertion protruding portion 181 is held by the annular elastic member 182. In accordance with such the embodiment, the structure is preferable for forming the first and second injection valve support members 100S and 100P by a synthetic resin material similarly to the embodiment mentioned above. Particularly, since the tubular member 170 is abolished with respect to the embodiment mentioned above, and the communication of fuel is achieved by the insertion hole 180 integrally formed at the first injection valve support member 100S and the insertion protruding portion 181 integrally formed at the second injection valve support member 100P, it is possible to achieve a reduction of a parts number, and a reduction of an assembling man hour. In this case, it is possible to achieve the operation and effect of the cylinder collar 174 and the elastic pressing member 173 similarly to the embodiment mentioned above. Further, it is possible to execute the maintenance work of the fuel injection valves 100Ja and 100Jb in the same manner as the embodiment mentioned above. Further, the insertion hole 180 may be provided at the second injection valve support member 100P, and the insertion protruding portion 181 may be provided at the first injection valve support member 100S.

What is claimed is:

1. A fuel distribution pipe structure for a plurality of throttle bodies wherein each of said bodies is provided with a fuel injection valve and said bodies are arranged in a position separated from each other by a given distance, and fuel is supplied to each of said fuel injection valves from a fuel distribution pipe, said fuel distribution pipe structure comprising:

a distribution member detachably supported between a first throttle body and a second throttle body, first and second injection valve support members detachably coupled between a first side wall of said first throttle body and a second side wall of said second throttle body;

wherein said distribution member is provided with a first flat surface and a second flat surface, said first and second surfaces of the distribution member being parallel to each other, and said distribution member is provided with a fuel distribution path, throttle body mounting holes, and injection valve support member mounting holes, said distribution path, throttle body mounting holes and valve support member mounting holes each extending from said first fiat surface to said second flat surface of the distribution member, said distribution member having a fuel inflow boss, said fuel distribution path in communication with a fuel inflow path of the fuel inflow boss;

wherein each of said injection valve support members is provided with a first flat surface and a second flat surface, said first and second surfaces of the injection valve support members are parallel to each other; each injection valve support member is provided with mounting thread holes extending from said first fiat surface of the injection valve support member to said second flat surface of the injection valve support member and with an injection valve support boss extending diagonally away from said second flat surface of the injection valve support member;

wherein each injection valve support boss is provided with a fuel supply path extending in a longitudinal direction thereof, one end of said fuel supply path is open at said second flat surface and the other end of said fuel supply path is connected to an injection valve support hole which is open at a lower end of said injection valve support boss;

wherein each injection valve support member is mounted respectively on each flat surface of said distribution member so that said fuel distribution path in said distribution member is in communication with each of the fuel supply paths in the injection valve support members;

wherein bolts are inserted into said mounting thread holes in said distribution member and said mounting thread holes in each injection valve support member so that each injection valve support member is secured to each flat surface of said distribution member; and wherein first and second fuel injection valves and provided on said first and second throttle bodies and are coupled to said first and second injection valve support members, respectively.

2. The fuel distribution pipe structure as claimed in claim 1, wherein said first and second injection valve support members and are formed into the same configuration for common use of an injection valve support member.

3. A fuel distribution pipe structure for a plurality of throttle bodies wherein each of said bodies is provided with a fuel injection valve and said bodies are arranged in a position separated from each other by a given distance, and fuel is supplied to each of said fuel injection valves from a fuel distribution pipe, said fuel distribution pipe structure comprising:

a distribution member detachably supported between a first throttle body and a second throttle body, first and second injection valve support members detachably coupled between a first side wall of said first throttle body and a second side wall of said second throttle body;

wherein said distribution member is formed from a flat rigid material and is provided with a first flat surface and a second flat surface, said first and second surfaces of the distribution member being parallel to each other, and said distribution member is provided with a communication hole, injection valve support member mounting holes, and throttle body mounting holes extending from said first flat surface to said second flat surface of the distribution member;

wherein said first injection valve support member includes a first mounting collar portion, a first injection valve support boss, and a fuel inflow path, said first mounting collar portion is provided with a first flat surface and mounting holes extending through said collar portion, a first fuel communication path which is open at said first flat surface of said first mounting collar portion is in communication with a fuel supply path from a lower end of said first injection valve support boss via an injection valve support hole;

wherein said second injection valve support member includes a second mounting collar portion, and a second injection valve support boss, said second mounting collar portion is provided with a first flat surface, and mounting holes extending through said portion, a second fuel communication path which is open at said first flat surface of said second mounting flange portion is in communication with a fuel supply path from a lower end injection valve support hole;

wherein each injection valve support member is mounted respectively on each flat surface of said distribution member so that said fuel distribution path in said distribution member is in communication with each of the fuel supply paths in the injection valve support members;

wherein first and second fuel injection valves provided on said first and second throttle bodies are coupled to said first and second injection valve support members, respectively;

wherein said first flat surface of said second injection valve support member is disposed on said first flat surface of said distribution member so that said second fuel communication path is in communication with said communication hole; and wherein said first and second injection valve support members and said distribution member are secured to one another by bolts.

4. The fuel distribution pipe structure as claimed in claim 3, wherein said first and second injection valve support member are made of a synthetic resin material, a tubular member is disposed in said communication hole of said distribution member, said first fuel communication path of said first injection valve support member and said second fuel communication path of said second injection valve support member are in communication with each other through said tubular member, a first annular elastic member is disposed in a compression manner between an outer periphery of said tubular member and an inner periphery of said fast fuel communication path, and a second annular elastic member is disposed in a compression manner between an outer periphery of said tubular member and an inner periphery of said second fuel communication path.

5. The fuel distribution pipe structure as claimed in claim 3, wherein said first and second injection valve support members are made of a synthetic resin material, said first injection valve support member is provided with an insertion hole which is open at said first flat surface of said first injection valve support member, said fuel supply path of said first injection valve support boss is in communication with said fuel inflow path, an insertion protruding portion is provided on said first flat surface of said second injection valve support member, said fuel supply path of said second injection valve support member is open toward a leading end portion of said insertion protruding portion, said insertion protruding portion is arranged in an inner side of said communication hole of said distribution member so as to be inserted into said insertion hole, and an annular elastic member is disposed in a compression manner between an outer periphery of said insertion protruding portion and an inner periphery of said insertion hole.

6. The fuel distribution pipe structure as claimed in claim 4, wherein cylinder collars are made of a metal material and are inserted into said mounting holes of said first injection valve support body, said injection valve support member mounting holes of said distribution member, and said mounting holes of said second injection valve support body, an overall length of each cylinder collar in a bolt fastening direction is set to $H \geqq N$ where N is the total thickness of a thickness of said first mounting collar portion of said first injection valve support body, a thickness of said distribution member, and a thickness of said second mounting collar portion of said second injection valve support body, and elastic pressing members are disposed in a compression manner among said first injection valve support member, said distribution member, and said second injection valve support member.

7. The fuel distribution pipe structure as claimed in claim 5, wherein cylinder collars made of a metal material are inserted into said mounting holes of said first injection valve support body, said injection valve support member mounting holes of said distribution member, and said mounting holes of said second injection valve support body, an overall length of each cylinder collar in a bolt fastening direction is set to $H \geqq N$ where N is the total thickness of a thickness of said first mounting collar portion of said first injection valve support body, a thickness of said distribution member, and a thickness of said second mounting collar portion of said second injection valve support body, and elastic pressing members are disposed in a compression manner among said first injection valve support member, said distribution member, and said second injection valve support member.

* * * * *